US009343875B2

(12) United States Patent
Hanashi

(10) Patent No.: US 9,343,875 B2
(45) Date of Patent: May 17, 2016

(54) SPARK PLUG FOR INTERNAL COMBUSTION ENGINES AND MOUNTING STRUCTURE FOR THE SPARK PLUG

(71) Applicant: DENSO CORPORATION, Kariya, Aichi-pref. (JP)

(72) Inventor: Ken Hanashi, Obu (JP)

(73) Assignee: DENSO CORPORATION, Kariya (JP)

( * ) Notice: Subject to any disclaimer, the term of this patent is extended or adjusted under 35 U.S.C. 154(b) by 197 days.

(21) Appl. No.: 14/355,708

(22) PCT Filed: Oct. 31, 2012

(86) PCT No.: PCT/JP2012/078179
§ 371 (c)(1),
(2) Date: May 1, 2014

(87) PCT Pub. No.: WO2013/065741
PCT Pub. Date: May 10, 2013

(65) Prior Publication Data

US 2014/0318490 A1 Oct. 30, 2014

(30) Foreign Application Priority Data

Nov. 1, 2011 (JP) ..... 2011-240354

(51) Int. Cl.
*H01T 13/02* (2006.01)
*F02P 13/00* (2006.01)
(Continued)

(52) U.S. Cl.
CPC ..... *H01T 13/02* (2013.01); *F02P 13/00* (2013.01); *H01T 13/20* (2013.01); *H01T 13/32* (2013.01); *H01T 1/22* (2013.01)

(58) Field of Classification Search
CPC ..... H01T 13/32; H01T 13/20; H01T 13/39; H01T 21/02; H01T 13/467; H01T 13/16; H01T 13/40; H01T 13/50; H01T 13/34; H01T 13/36; H01T 13/54; H01T 13/02; H01T 13/52; H01T 21/06; H01T 13/05; H01T 1/20; H01T 1/22; F02P 13/00
See application file for complete search history.

(56) References Cited

U.S. PATENT DOCUMENTS 4,329,615 A * 5/1982 Tanaka ..... H01T 13/20 313/139
6,166,480 A * 12/2000 Ishida ..... H01T 13/20 313/141

(Continued)

FOREIGN PATENT DOCUMENTS

JP 61-16604 5/1986
JP S6116604 5/1986

(Continued)

OTHER PUBLICATIONS

Office Action (2 pgs.) dated Aug. 18, 2015 issued in corresponding Japanese Application No. 2011-240354 with an at least partial English-language translation (2 pgs.).

(Continued)

*Primary Examiner* — Marguerite McMahon
*Assistant Examiner* — Tea Holbrook
(74) *Attorney, Agent, or Firm* — Nixon & Vanderhye P.C.

(57) ABSTRACT

A spark plug for an internal combustion engine includes a housing, an insulation porcelain, a center electrode and a ground electrode. Both of a tip portion of the center electrode and an opposing portion of the ground electrode are provided with respective projection portions which are projected toward a spark discharge gap. At least one of the projection portions has an opposing face that confronts the spark discharge gap and is inclined with respect to a plane perpendicular to an axial direction of the plug. The spark discharge gap is configured to be gradually enlarged, in one direction perpendicular to the axial direction of the plug, from a narrow gap on one end side toward a wide gap on the other end side.

17 Claims, 18 Drawing Sheets

(51) Int. Cl.

| | |
|---|---|
| ***H01T 13/32*** | (2006.01) |
| ***H01T 13/20*** | (2006.01) |
| *H01T 1/22* | (2006.01) |

(56) References Cited

U.S. PATENT DOCUMENTS

| | | | | |
|---|---|---|---|---|
| 7,148,612 | B2 * | 12/2006 | Pino | H01T 13/32 313/141 |
| 7,449,822 | B2 * | 11/2008 | Yorita | H01T 13/39 123/169 EL |
| 8,884,504 | B2 * | 11/2014 | Hanashi | F02P 13/00 313/141 |
| 2001/0015602 | A1 * | 8/2001 | Hori | H01T 21/06 313/141 |
| 2002/0157629 | A1 * | 10/2002 | Inagaki | H01T 13/08 123/169 PA |
| 2003/0155849 | A1 | 8/2003 | Hori | |
| 2005/0029915 | A1 | 2/2005 | Yorita et al. | |
| 2007/0277764 | A1 * | 12/2007 | Ito | H01T 13/39 123/169 R |
| 2010/0012083 | A1 * | 1/2010 | Tanaka | F02B 23/101 123/305 |
| 2014/0265816 | A1 * | 9/2014 | Hanashi | F02P 13/00 313/141 |
| 2014/0299087 | A1 * | 10/2014 | Hanashi | F02P 13/00 123/146.5 R |

FOREIGN PATENT DOCUMENTS

| | | |
|---|---|---|
| JP | 2003-317896 | 11/2003 |
| JP | 2004241267 | 8/2004 |
| JP | 2005-56786 | 3/2005 |
| JP | 2008-303840 | 12/2008 |
| JP | 2009-129908 | 6/2009 |
| JP | 2009-200002 | 9/2009 |
| JP | 2009-252525 | 10/2009 |
| JP | 2010-238377 | 10/2010 |
| WO | WO 2010/038467 | 4/2010 |

OTHER PUBLICATIONS

The International Bureau, "International Preliminary Report on Patentability," issued in corresponding International Patent Application No. PCT/JP2012/078179, dated May 15, 2014.

"Information Offer Form," as submitted in the Japanese Patent Office in corresponding Japanese Patent Application No. 2011-240354, dated Feb. 10, 2015.

International Search Report for PCT/JP2012/078179, mailed Feb. 5, 2013.

Office Action (10 pages) dated Mar. 11, 2015, issued in corresponding Chinese Application No. 201280053723.7 and English translation (15 pages).

* cited by examiner (A)

(B)

(A)

(B)

SPARK PLUG FOR INTERNAL COMBUSTION ENGINES AND MOUNTING STRUCTURE FOR THE SPARK PLUG

CROSS-REFERENCE TO RELATED APPLICATION

This application is the U.S. national phase of International Application No. PCT/JP2012/078179 filed 31 Oct. 2012 which designated the U.S. and claims priority to JP Application No. 2011-240354 filed Nov. 1, 2011, the entire contents of each of which are hereby incorporated by reference.

TECHNICAL FIELD

The present invention relates to a spark plug for an internal combustion engine and a mounting structure for the spark plug, the spark plug being used for passenger cars, automatic two-wheeled vehicles, cogeneration systems, gas pressure pumps or the like.

BACKGROUND TECHNIQUE

FIG. 1 shows a conventionally used spark plug 9 for an internal combustion engine. For example, the spark plug 9 is used as a means for igniting an air-fuel mixture introduced into a combustion chamber of an internal combustion engine such as of a passenger car.

The spark plug 9 includes a center electrode 94 and a ground electrode 95. The ground electrode 95 has an end fixed to a housing 92. The ground electrode 95 is bent to bring the other end to a position facing the center electrode 94. Thus, a spark discharge gap 911 is formed between the center electrode 94 and the ground electrode 95.

In the ground electrode 95, a projection portion 96 is arranged, being projected toward the spark discharge gap 911. The projection portion 96 has an opposing face 960 that faces the center electrode 94. As shown in FIG. 2 by (A) and (B), a discharge is caused in the spark discharge gap 911 and the air-fuel mixture is ignited by the discharge. A reference E in the figure indicates a discharge spark formed by the discharge, a reference F indicates a flow of the air-fuel mixture and a reference I indicates a flame (see Patent Document 1).

Patent Document 2 discloses a spark plug having a ground electrode in a shape that is engineered to minimize wear.

PRIOR ART DOCUMENTS

Patent Documents

[Patent Document 1] JP-A-2003-317896
[Patent Document 2] JP-A-2009-252525

SUMMARY OF THE INVENTION

Problems to be Solved by the Invention

However, recently, various lean-burn internal combustion engines have been developed to enhance fuel efficiency. In lean burn, the flow speed of the air-fuel mixture in the combustion chamber is required to be high in order to retain ignitability to the air-fuel mixture. Therefore, when the spark plug 9 as shown in Patent Document 1 is used, the discharge spark E tends to be expanded and cut according to the increase of the flow speed of the air-fuel mixture, as shown in FIG. 2 by (C), before the air-fuel mixture is heated by the discharge spark E in the spark discharge gap 911. When the discharge spark E is extinguished, a phenomenon of causing a discharge for the second time (hereinafter this is referred to re-discharge) occurs and this is repeated. The discharge spark E drifts constantly in a constant direction, i.e. downstream, due to the gas flow to repeat re-discharges in a downstream-side edge portion 966 of the projection portion 96. Thus, this portion tends to be disproportionately worn out (hereinafter this is referred to as disproportionate wear). As a result, the life of the spark plug is problematically shortened.

On the other hand, generally, the life of a spark plug may be lengthened by increasing the diameter of the projection portion 96 and enhancing wear resistance.

However, in this case, the opposing face 960 of the projection portion 96 is enlarged and therefore the opposing face 960 may draw heat from the flame F in a period when flame grows and may inhibit growth of the flame F (hereinafter this is referred to as quenching action). As a result, ignitability of the spark plug may be impaired.

As high compression is promoted in the combustion chamber of an internal combustion engine, there is a concern that the discharge voltage may increase. Accordingly, the increase of the discharge voltage is required to be minimized. To cope with this, the spark discharge gap may be made small. In this case, however, the quenching action is easily induced and therefore it is difficult to enhance ignitability.

In the spark plug described in Patent Document 2, the ground electrode is ensured to be in a shape in which the volume on the downstream side with reference to the flow of the air-fuel mixture is ensured to be larger than the volume on the upstream side. However, in the absence of a projection portion, the quenching action tends to be accelerated, which is disadvantageous in enhancing ignitability. In the spark plug described in Patent Document 2, the ground electrode does not have a projection portion but this does not solve the problem of wear in the projection portion mentioned above.

It is thus desired to provide a spark plug for an internal combustion engine and a mounting structure for the spark plug, with which ignitability and life of the plug are enhanced, while quenching action and discharge voltage are minimized.

Means for Solving the Problems

An aspect of the present disclosure lies in a spark plug for an internal combustion engine that includes a cylindrical housing, a cylindrical insulation porcelain held inside the housing, a center electrode held inside the insulation porcelain, with a tip portion thereof being projected, and a ground electrode connected to the housing and having an opposing portion opposed to the center electrode in an axial direction of the plug to form a spark discharge gap between the center electrode and the ground electrode, the spark plug being characterized in that: both of the tip portion of the center electrode and the opposing portion of the ground electrode have respective projection portions projected toward the spark discharge gap; at least one of the projection portions has an opposing face confronting the spark discharge gap and inclined with respect to a plane perpendicular to the axial direction of the plug; and the spark discharge gap is configured to be gradually enlarged, in one direction perpendicular to the axial direction of the spark plug, from a narrow gap on one end side in the direction, the narrow gap having a gap length smaller than on the other end side, toward a wide gap on the other end side, the wide gap having a gap length larger than on the one end side.

Another aspect lies in a mounting structure for a spark plug, in which the spark plug is mounted to an internal combustion engine, the mounting structure being characterized in that the spark discharge gap is arranged such that the narrow gap side is located upstream of the wide gap side with respect to a flow of an air-fuel mixture supplied to the combustion chamber of the engine.

Advantageous Effects of the Invention

In the spark plug, at least one of the projection portions has an opposing face that confronts the spark discharge gap and is inclined with respect to a plane perpendicular to the axial direction of the plug. The spark discharge gap is configured to be gradually enlarged, in one direction perpendicular to the axial direction of the plug, such that a narrow gap is formed on one end side and a wide gap is formed on the other end side. In mounting the spark plug to the combustion chamber of an internal combustion engine, the narrow gap side of the projection portions is ensured to be located upstream of the wide gap side with respect to a flow of an air-fuel mixture in the combustion chamber. Thus, discharge voltage of the spark plug is minimized and wear resistance and ignitability of the spark plug are enhanced.

This mechanism is described below.

When the spark plug is arranged as described above with respect to an internal combustion engine, the narrow gap is located on an upstream side. Electric field is most easily concentrated in the vicinity of the narrow gap and hence one end side of the projection portions is likely to serve as a start point of discharge. As a result, discharge voltage can be minimized. By locating the one end side on an upstream side, the one end side forming the small gap, an initial discharge spark can be obtained on the upstream side in the projection portions. Accordingly, time is guaranteed before the discharge spark is drifted downstream by the air-fuel mixture and blown off. Thus, an opportunity for the ignition (or, ignition opportunity) is well ensured and accordingly the number of times of occurring re-discharge is reduced to thereby easily minimize the progress of wear in the projection portions. As a result, wear resistance and ignitability of the spark plug are enhanced.

With the above arrangement, the wide gap is located downstream in the flow in the projection portions. Accordingly, when the discharge spark is drifted downstream in the projection portions as mentioned above, the length of the discharge spark across the center electrode and the ground electrode (hereinafter this is referred to as discharge length) can be increased. Thus, the discharge length of the discharge spark is easily ensured to be long, while the ignition opportunity for the air-fuel mixture is well ensured. As a result, ignitability of the spark plug is enhanced.

The foregoing configuration is realized by inclining an opposing face confronting the spark discharge gap, with respect to a plane perpendicular to the axial direction of the plug in at least one of the projection portions, and gradually enlarging the spark discharge gap in one direction perpendicular to the axial direction of the plug, from the narrow gap on one end side toward the wide gap on the other end side. Accordingly, wear resistance is enhanced without the necessity of particularly increasing the diameter of the projection portions. Thus, the life of the spark plug is enhanced, suppressing quenching action.

As described above, it is possible to provide a spark plug for an internal combustion engine, the spark plug being able to enhance ignitability and life of the plug, while being able to suppress quenching action and discharge voltage, and can provide a mounting structure for the spark plug.

MODES FOR IMPLEMENTING THE INVENTION

Hereinafter are described several embodiments of a spark plug for an internal combustion engine and a mounting structure for the spark plug, according to the present invention.

The spark plug for an internal combustion engine may be used as an igniting means for an internal combustion engine such as of passenger cars, automatic two-wheeled vehicles, cogeneration, or gas pressure pumps.

In the following description, a side of the spark plug, which is inserted into the combustion chamber of an internal combustion engine, is referred to as a tip side, and a side opposite to the tip side is referred to as a base side.

First Embodiment

Referring to FIGS. 3 to 7, a spark plug of an embodiment is described.

Figure 3:
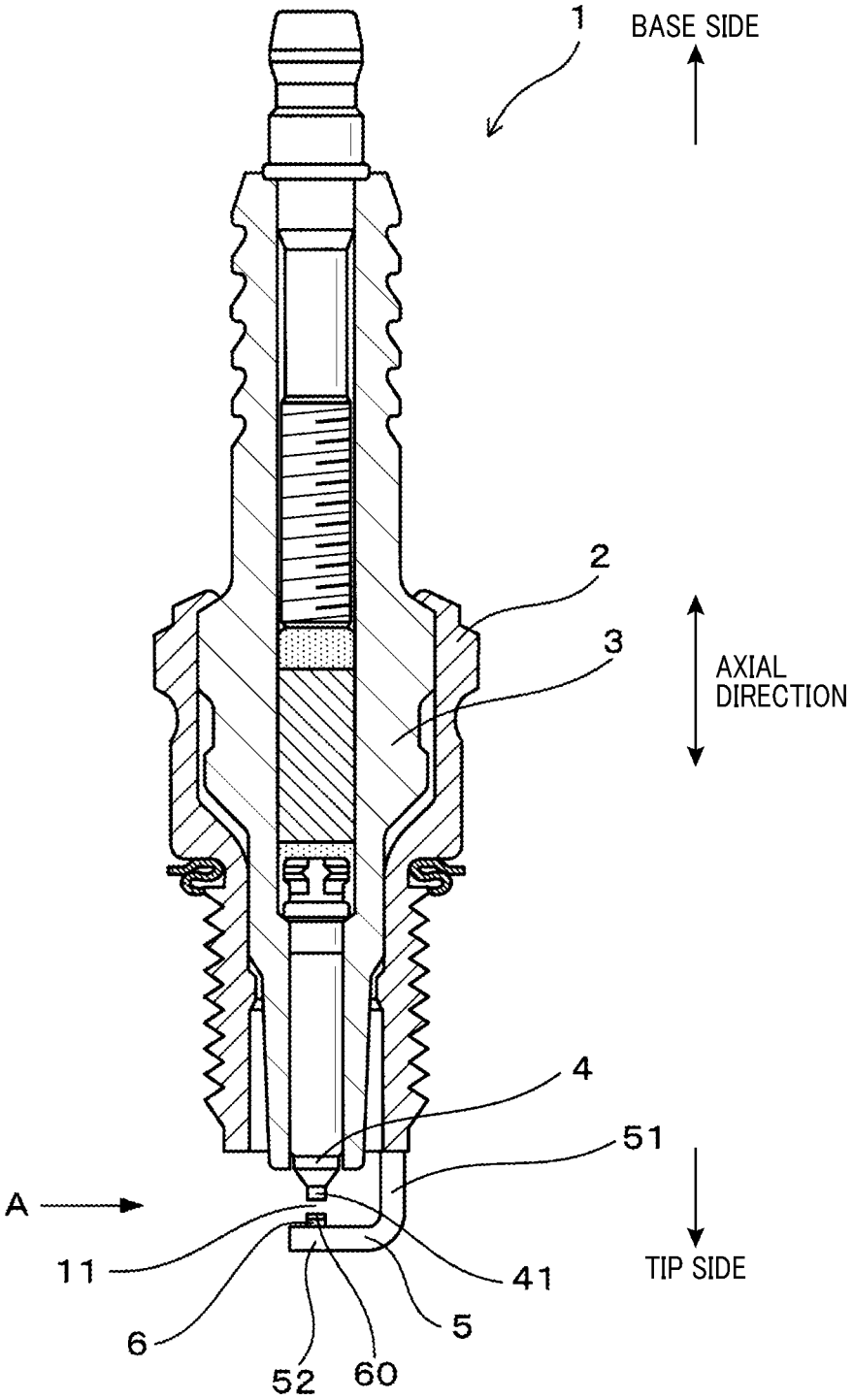
FIG. 3 is an explanatory view illustrating a partial cross section of a spark plug, according to a first embodiment.

As shown in FIG. 3, a spark plug 1 of the present embodiment includes: a cylindrical housing 2; a cylindrical insulation porcelain 3 held inside the housing 2; a center electrode 4 held inside the insulation porcelain 3 such that a tip portion is projected; and a ground electrode 5 connected to the housing 2 and having an opposing portion 52 that faces the center electrode 4 in an axial direction of the plug (longitudinal direction of the spark plug 1: see FIG. 3) to form a spark discharge gap 11 between the center electrode 4 and the ground electrode 5.

A tip portion of the center electrode 4 and the opposing portion 52 of the ground electrode 5 are both arranged with a projection portion 41 and a projection portion 6, respectively, which are projected toward the spark discharge gap 11.

Figure 4:
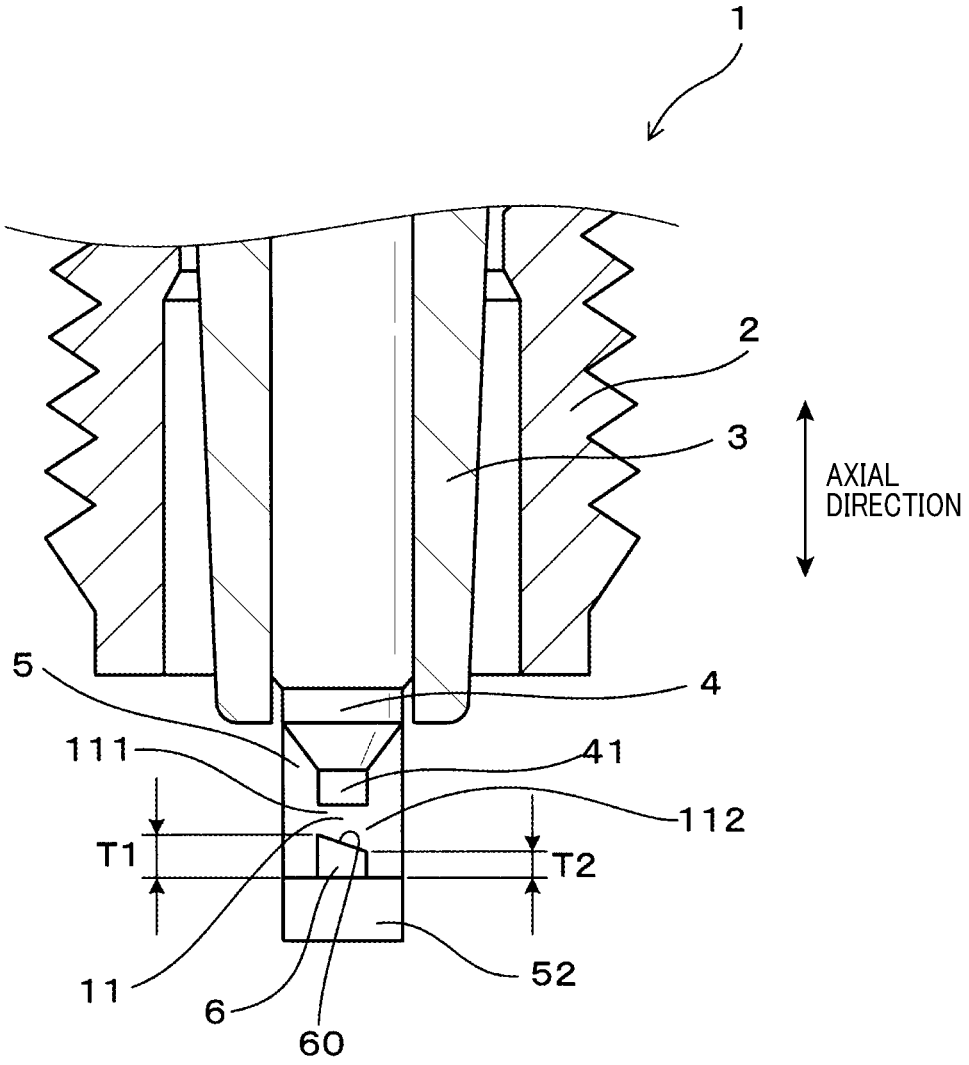
FIG. 4 is a diagram as viewed from an arrow A of FIG. 3.

As shown in FIG. 4, the projection portion 6 arranged at the ground electrode 5 has an opposing face 60 confronting the spark discharge gap 11. The opposing face 60 is inclined with respect to a plane perpendicular to the axial direction of the plug.

Also, as shown in the figure, in one direction perpendicular to the axial direction of the plug, the spark discharge gap 11 is configured so as to be gradually enlarged from a narrow gap 111 formed on one side of the direction toward a wide gap 112 formed on the other end side of the direction. Compared to the other end side gap (i.e. wide gap 112), the narrow gap 111 has a smaller gap length in the axial direction of the plug. On the other hand, compared to the one end side gap (i.e. narrow gap 111), the wide gap 112 has a larger gap length in the axial direction of the plug. In other words, the term "narrow" in the narrow gap 111 and the term "wide" in the wide gap 112 express a mutual magnitude correlation.

Figure 6:
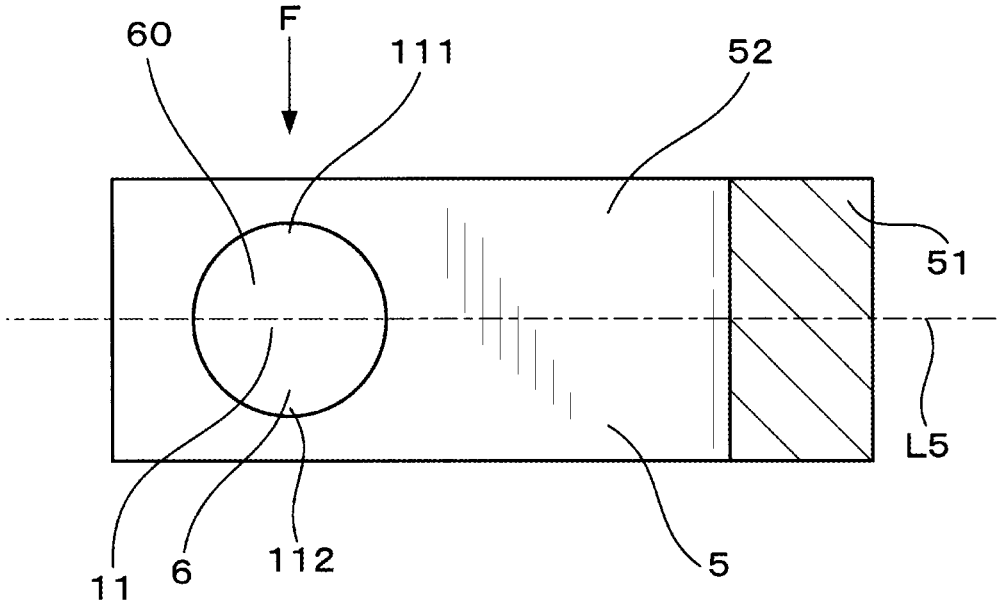
FIG. 6 is a diagram taken along a line B-B of FIG. 5.

In the present embodiment, the spark discharge gap 11 is configured so as to be gradually enlarged along a direction perpendicular to a direction in which the opposing portion 52 of the ground electrode 5 is extended (broken line L5 shown in FIG. 6).

In the spark plug 1 of the present embodiment, the housing 2, for example, has a diameter of 10 mm. Further, the tip portion of the center electrode 4 is projected by 1.5 mm in the axial direction from the tip of the insulation porcelain 3.

The projection portion 41 has a circular cross section perpendicular to the axial direction of the plug, with the whole being in substantially a pillar shape. The projection portion 41 has a height of 0.6 mm in the axial direction of the plug.

As shown in FIG. 3, the ground electrode 5 includes: a vertical portion 51 vertically provided on the tip side, with its one end being fixed to the tip portion of the housing 2; and the opposing portion 52 provided, being crooked, from the other end of the vertical portion 51 so as to face the center electrode 4 in the axial direction of the plug.

For example, the projection portion 6 is configured by a noble metal chip made of a platinum alloy or the like. In the present embodiment, a noble metal chip is bonded to the opposing portion 52 of the ground electrode 5 by welding, so that the noble metal chip configures the projection portion 6.

The projection portion 6 is in substantially a pillar shape, with its one end face (opposing face 60) being inclined with respect to the axial direction.

The base material of the housing 2 and the ground electrode 5 (portion other than the projection portion 6) is a nickel alloy.

In the present embodiment, the tip portion of the center electrode 4 is configured by the projection portion 41 which is in a substantially pillar shape and formed of a noble metal chip. For example, the noble metal chip may be configured by an iridium alloy.

It should be appreciated that the spark plug 1 of the present embodiment is used in an internal combustion engine for vehicles, such as passenger cars.

Figure 5:
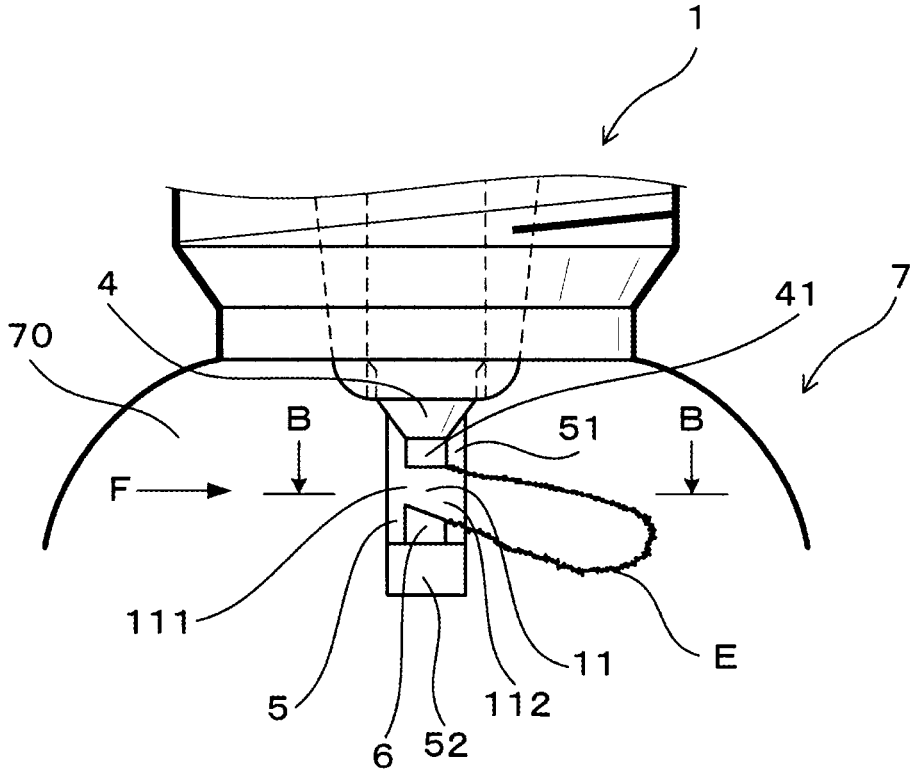
FIG. 5 is an explanatory view illustrating the spark plug mounted into a combustion chamber, according to the first embodiment.

Referring now to FIGS. 5 and 6, hereinafter is described a mounting structure in which the spark plug 1 of the present embodiment is mounted to an internal combustion engine 7.

The spark plug 1 is mounted to the internal combustion engine 7, using, for example, a well-known technique (e.g., JP-A-H11-324878 or JP-A-H11-351115). Using the well-known technique, the spark plug 1 is mounted to the internal combustion engine 7, adjusting the position of the ground electrode 5 with respect to the direction of a flow F of an air-fuel mixture in a combustion chamber 70.

Specifically, as shown in FIGS. 5 and 6, in mounting the spark plug 1 to the internal combustion engine 7, the ground electrode 5 is adjusted such that the extending direction (broken line L5 shown in FIG. 6) of the opposing portion 52 of the ground electrode 5 will be perpendicular to the direction of the flow F. More specifically, the spark plug 1 is mounted to the internal combustion engine 7 such that the vertical portion 51 of the ground electrode 5 will not block the flow F. As shown in the figures, in the arrangement, it is ensured that the projection portion 6 is placed in the combustion chamber 70 such that the narrow gap 111 is located upstream of the wide gap 112 with respect to the flow F of the air-fuel mixture supplied to the combustion chamber 70.

Figure 7:
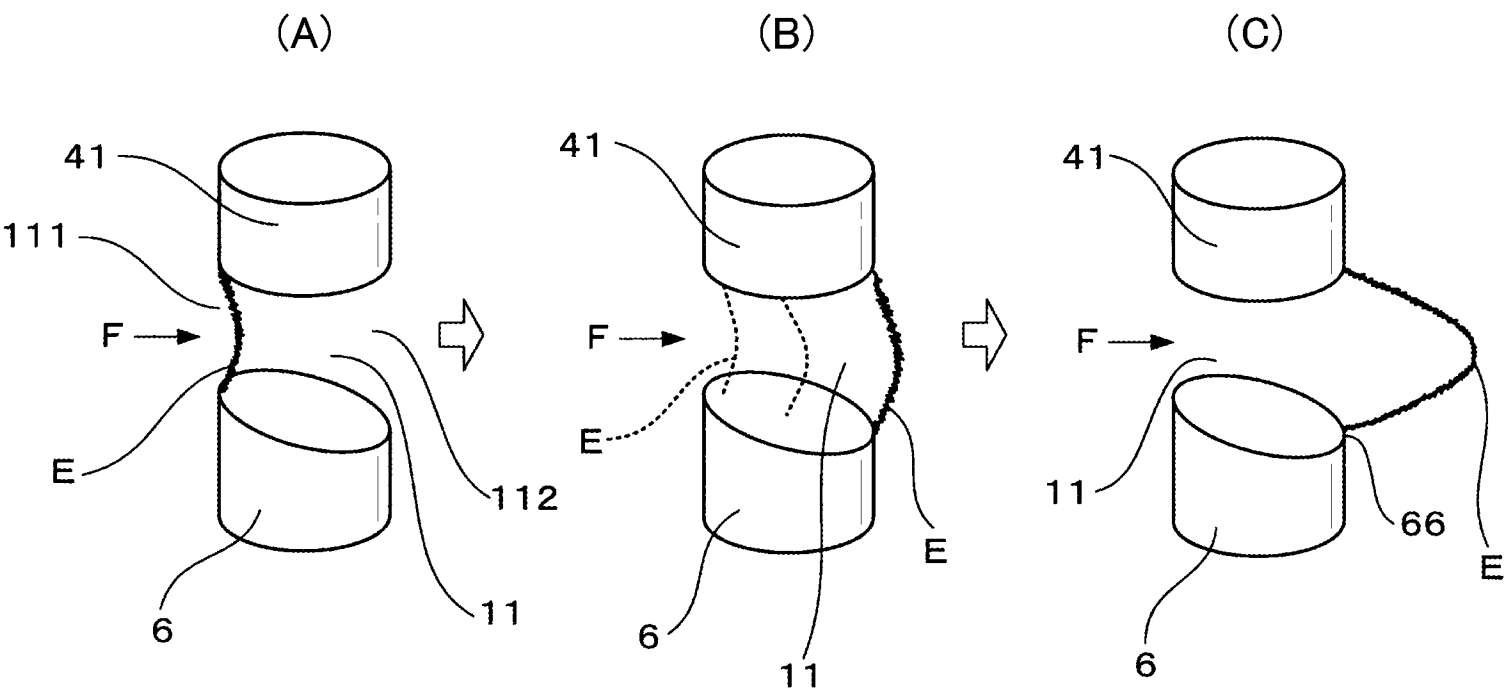
FIG. 7 is an explanatory view illustrating a projection portion, according to the first embodiment, specifically showing by (A) a state of discharge, by (B) movement of a discharge spark, and by (C) a state where the discharge spark is blown and elongated.

Referring to FIG. 7, hereinafter is specifically described the movement and the shape of a discharge spark E in the projection portion 6 when a discharge is caused in the spark plug 1 of the present embodiment, as well as a process of igniting the air-fuel mixture based on the movement and the shape.

A predetermined voltage is applied across the center electrode 4 and the ground electrode 5 to cause a discharge in the spark discharge gap 11. In the discharge, as shown in FIG. 7 by (A), the discharge spark E is initially obtained upstream in the projection portion 6. Specifically, the initial discharge spark E is caused in the narrow gap 111 in which the field intensity is likely to be large. Then, as shown in FIG. 7 by (B), the discharge spark E drifts downstream, with its discharge length being increased, by the flow F of the air-fuel mixture F. Then, as shown in FIG. 7 by (C), the discharge spark E is blown and elongated to a large extent at an edge portion 66 downstream in the projection portion 6. During this period, the air-fuel mixture is ignited by the discharge spark E.

Referring to FIGS. 3 to 7, advantageous effects of the present embodiment are described.

As shown in FIGS. 3 and 4, in the projection portion 6 of the spark plug, the opposing face 60 that confronts the spark discharge gap 11 is inclined with respect to a plane perpendicular to the axial direction of the plug. Further, in one direction perpendicular to the axial direction of the plug, the spark discharge gap 11 is configured to be gradually enlarged from one end side toward the other end side so that the small gap 111 is formed on one end side and the wide gap 112 is formed on the other end side. In mounting the spark plug 1 to the combustion chamber 70 of the internal combustion engine, the spark plug 1 is arranged such that the narrow gap 111 of the projection portion 6 is located upstream of the wide gap 112, with respect to the flow F of the air-fuel mixture in the combustion chamber 70. Thus, the discharge voltage of the spark plug 1 is minimized and wear resistance and ignitability are enhanced.

This mechanism is described below.

When the spark plug 1 is arranged, as described above, with respect to the internal combustion engine 7, the narrow gap 111 is arranged upstream. Electric field is most easily concentrated in the vicinity of the narrow gap 111 and hence one end side of the projection portion 6 is likely to serve as a start point of discharge. As a result, the discharge voltage is minimized. Further, by arranging one end side on an upstream side, one end side forming the narrow gap 111, the initial discharge spark E can be obtained on the upstream side in the projection portion 6. This guarantees time before the discharge spark E drifts downstream by the air-fuel mixture and blown off. Accordingly, an opportunity for the ignition is well ensured and accordingly the number of times of re-discharge is minimized to thereby minimize the progress of wear in the projection portion 6. As a result, wear resistance and ignitability of the spark plug 1 are enhanced.

With the arrangement as described above, the wide gap 112 is located downstream in the flow in the projection portion 6. Therefore, as mentioned above, when the discharge spark E is drifted downstream in the projection portion 6, the discharge length of the discharge spark E across the center electrode 4 and the ground electrode 5 can be made large (see FIG. 5). Thus, the discharge length of the discharge spark E is easily ensured to be large and an ignition opportunity for the air-fuel mixture is well obtained. As a result, ignitability of the spark plug 1 is enhanced.

The configuration described above is realized by configuring the projection portion 6 such that the opposing face 60 confronting the spark discharge gap 11 will be inclined with respect to a plane perpendicular to the axial direction of the plug, and that, in one direction perpendicular to the axial direction of the plug, the spark discharge gap 11 will be gradually enlarged from the narrow gap 111 on one end side toward the wide gap 112 on the other end side. Thus, without the necessity of particularly increasing the diameter of the projection portion, wear resistance is enhanced. Accordingly, while suppressing quenching action, the life of the spark plug 1 is enhanced.

The spark discharge gap 11 is configured to be gradually enlarged along a direction perpendicular to the extending direction (broken line L5 shown in FIG. 6) of the opposing portion 52 of the ground electrode 5. Thus, the spark plug 1 is arranged such that the wide gap 112 is located downstream in the flow F that flows toward the spark discharge gap 11, and the narrow gap 111 is located upstream in the flow F, while the flow F is reliably prevented from being blocked by the ground electrode 5. Therefore, as mentioned above, wear resistance of the projection portion 6 is enhanced, and an ignition opportunity is well ensured. As a result, the life of the spark plug 1 is enhanced, and at the same time, ignitability is more effectively enhanced. In addition, discharge voltage is more effectively minimized.

As described above, according to the present embodiment, a spark plug for an internal combustion engine and a mounting structure for the spark plug can be provided, the spark plug being able to enhance ignitability and life of the plug, while minimizing quenching action and discharge voltage.

The projection portion 6 of the present embodiment may be arranged so that a first straight line L1 will obliquely intersect the broken line L5 at an angle of 45°, for example, the broken line L5 indicating the extending direction of the opposed portion 52 of the ground electrode. In this case as well, the wide gap 112 is ensured to be located downstream in the flow F which is directed to the spark discharge gap 11, and the narrow gap 111 is ensured to be located upstream in the flow F, while the flow F is ensured to be prevented from being blocked by the ground electrode 5. Thus, as mentioned above, wear resistance of the projection portion 6 is enhanced and at the same time an ignition opportunity is well ensured. As a result, ignitability of the spark plug 1 is enhanced while the life thereof is enhanced. Further, discharge voltage is effectively minimized.

Second Embodiment

Figure 8:
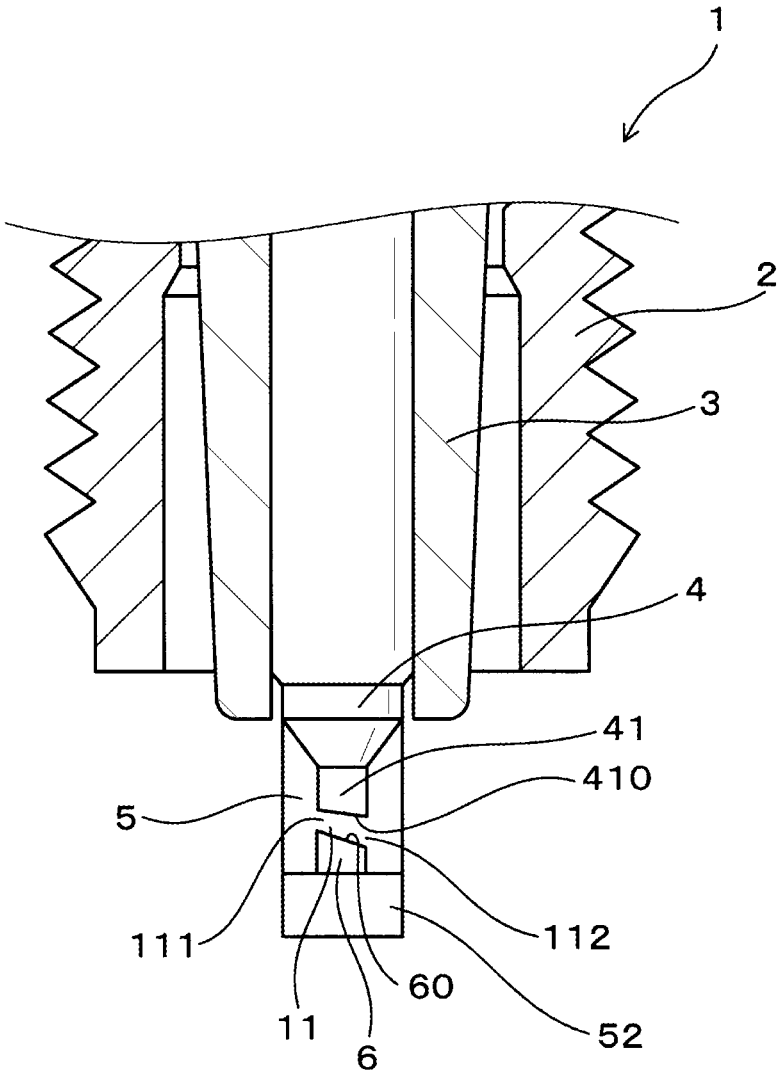
FIG. 8 is an explanatory view of a spark plug according to a second embodiment, the view corresponding to FIG. 4.

As shown in FIG. 8, in the present embodiment, both of the projection portions 41 and 6 of the center electrode 4 and the ground electrode 5, respectively, have inclined opposing faces 410 and 60, respectively.

In the present embodiment, the opposing faces 410 and 60 in both of the projection portions 41 and 6 of the center electrode 4 and the ground electrode 5, respectively, are inclined in the same direction with respect to a plane perpendicular to the axial direction of the plug. In this case, the inclination is directed toward the tip side of the spark plug 1 as the inclination extends from the narrow gap 111 side to the wide gap 112 side.

In the present embodiment as well, the spark plug 1 is arranged with respect to the internal combustion engine 7 such that the narrow gap 11 is located upstream in the flow F of the air-fuel mixture and the wide gap 112 is located downstream in the flow F. Thus, the opposing faces 410 and 60 in both of the projection portions 41 and 6 of the center electrode 4 and the ground electrode 5, respectively, are permitted to be directed to the tip side of the spark plug 1 as the opposing faces extend from upstream to downstream in the flow F.

The rest other than the above is similar to the first embodiment.

In the present embodiment, the direction of the flow F that has entered the spark discharge gap 11 can be changed and thus the flame can be easily expanded in the combustion chamber. Accordingly, ignitability of the spark plug 1 can be effectively enhanced.

Other than the above, the advantageous effects similar to those of the first embodiment are obtained.

Third Embodiment

Figure 9:
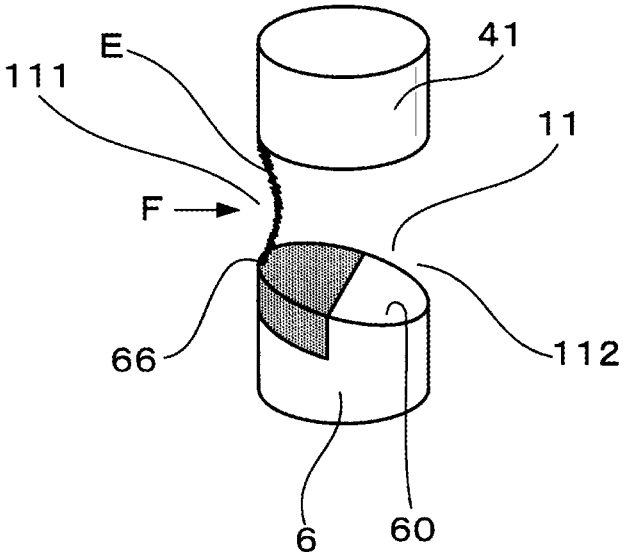
FIG. 9 is an explanatory view illustrating a projection portion in a state of discharge, according to a third embodiment.

As shown in FIG. 9, in the present embodiment, the ground electrode 5 of the spark plug 1 is provided with the projection portion 6 having the following configuration. Specifically, the projection portion 6 is configured such that the edge portion 66 confronting the narrow gap 111 of the spark discharge gap 11 is made of noble metal and the remaining portion is made of a nickel alloy.

The rest other than the above is similar to the first embodiment.

In the present embodiment, wear resistance is enhanced on one end side of the projection portion 6, one end side being in the narrow gap 111 where an initial discharge is caused. As a result, the life of the spark plug 1 is further lengthened. In addition, the manufacturing cost of the projection portion 6 can be reduced.

Other than the above, the advantageous effects similar to those of the first embodiment are obtained.

Fourth Embodiment

Figure 10:
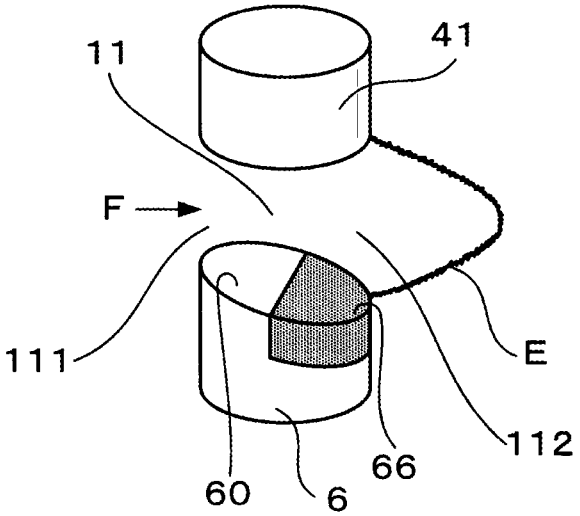
FIG. 10 is an explanatory view illustrating a projection portion in a state after discharge, according to a fourth embodiment.

As shown in FIG. 10, in the present embodiment, the ground electrode 5 of the spark plug 1 is provided with the projection portion 6 having the following configuration. Specifically, the projection portion 6 is configured such that, the edge portion 66 confronting the wide gap 112 of the spark discharge gap 11 is made of noble metal and the remaining portion is made of a nickel alloy.

The rest other than the above is similar to the first embodiment.

In the present embodiment, wear resistance is enhanced on the other end side of the projection portion 6, the other end side being in the wide gap 112 to which the discharge spark E is drifted. As a result, the life of the spark plug 1 is further lengthened. In addition, the manufacturing cost of the projection portion 6 can be reduced.

Other than the above, the advantageous effects similar to those of the first embodiment are obtained.

Fifth Embodiment

Figure 11:
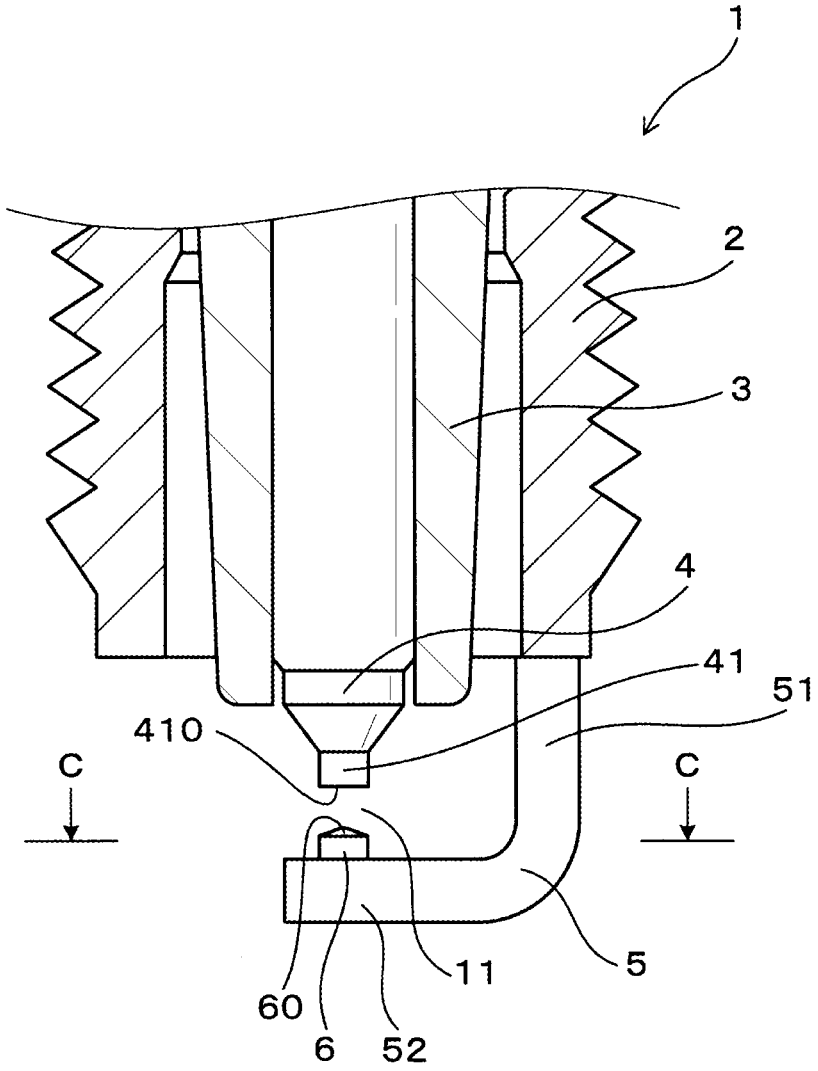
FIG. 11 is an explanatory view illustrating a partial cross section of a tip portion of a spark plug, according to a fifth embodiment.
Figure 12:
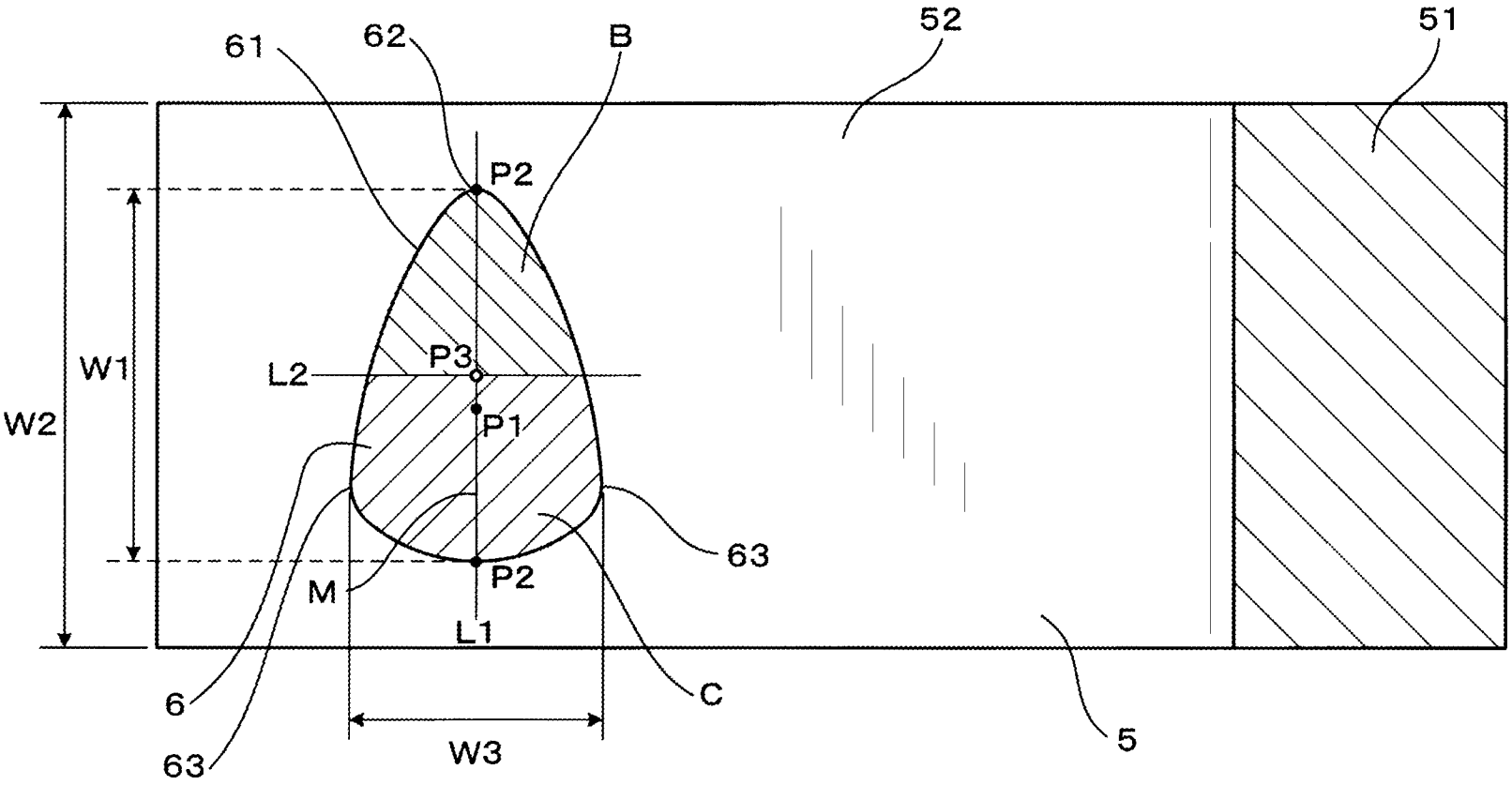
FIG. 12 is a diagram taken along a line C-C of FIG. 11.

As shown in FIGS. 11 to 15, in the present embodiment, the ground electrode 5 and the center electrode 4 of the spark plug 1 are provided with the projection portions 6 and 41, respectively, each having a cross section in a specific shape, as shown in FIG. 12, perpendicular to the axial direction of the plug.

The projection portions 6 and 41 have cross sections in the same shape perpendicular to the axial direction of the plug. First, the shape of the projection portion 6 is described.

As shown in FIGS. 11 and 12, in the projection portion 6, the cross section perpendicular to the axial direction of the plug is in a specific shape with a contour 61. The cross section includes a minimum curvature radius portion 62, whose curvature radius is the smallest in the contour 61. Also, the cross section is in the specific shape that satisfies the following requirement.

The requirement is defined as follows. Specifically, as shown in FIG. 12, first, a first straight line L1 is supposed to connect the minimum curvature radius portion 62 and a geometric centroid P1 in the cross section. Then, a first line segment M is supposed to connect between two intersections P2 at which the first straight line L1 intersects the contour 61 of the cross section. Then, a second straight line L2 is supposed to extend at right angle to the first line segment M, passing through a midpoint P3 of the first line segment M. Then, the cross section is divided by the second straight line L2 into a first region B that includes the minimum curvature radius portion 62 and a second region C that does not include the minimum curvature radius portion 62. The requirement is that, in this case, the area of the second region C is larger than that of the first region B.

In the present embodiment, the wide gap 112 is formed in the second region C and the narrow gap 111 is formed in the minimum curvature radius portion 62 of the first region B.

Further, as shown in FIG. 12, the projection portion 6 of the present embodiment is arranged such that the first straight line L1 will be perpendicular to the extending direction (broken line L5 shown in FIG. 13) of the opposing portion 52 of the ground electrode 5. The projection portion 6 is formed such that an overall length W1 thereof coinciding with the first straight line L1 will be smaller than a width W2 of the opposing portion 52, the width W2 being perpendicular to the extending direction of the opposing portion 52.

As shown in FIG. 12, the contour 61 of the cross section of the projection portion 6 is symmetric about the first straight line L1. The contour 61 is in a shape in which the width in the direction of the second straight line L2 is gradually increased from the minimum curvature radius portion 62 of the first region B (intersection P2 of the first region B) toward the second region C to thereby form maximum width portions 63 in the second region C. Also, in the shape, the contour 61 is tucked starting from the maximum width portions 63 toward the intersection P2 of the second region C. The maximum width portions 63 each have the smallest curvature radius in the contour 61 of the second region C.

The projection portion 6 has the overall length W1 of 0.88 mm along the first straight line L1 and has a width W3 (see FIG. 12) of 0.88 mm in a direction perpendicular to both a direction coinciding with the first straight line L1 and the axial direction of the plug. This shall not impose a limitation. For example, the overall length W1 of the projection portion 6 may be set to 0.83 mm and the width W3 may be set to 0.96 mm.

In the projection portion 6, the minimum curvature radius portion 62 in the first region B has a curvature radius R of 0.1 and each maximum width portion 63 in the second region C has a curvature radius R of 0.2. In the ground electrode 5, the width W2 of the opposing portion 52 is 2.4 mm.

Figure 14:
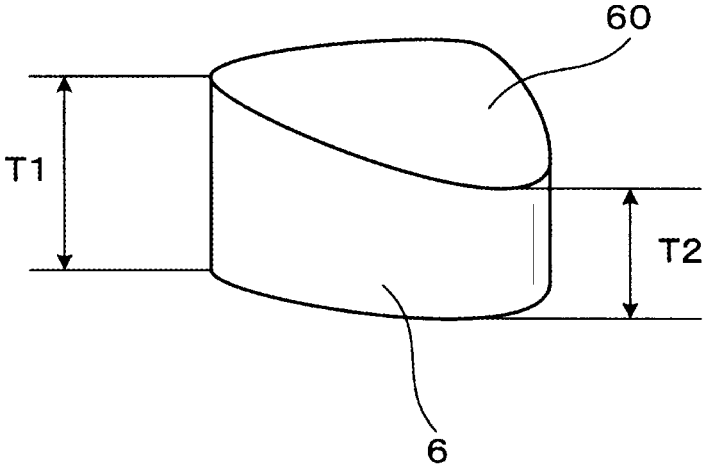
FIG. 14 is an explanatory view illustrating a perspective of a projection portion, according to the fifth embodiment.

As shown in FIG. 14, the projection portion 6 is in substantially a pillar shape in which the cross section meets the specific shape. Further, the projection section 6 has a maximum height T1 in the axial direction of the plug on one end side in a direction perpendicular to the axial direction of the plug, and has a minimum height T2 in the axial direction of the plug on the other end side. In other words, in the projection portion 6, the opposing face 60 that confronts the spark discharge gap 11 is inclined with respect to a plane perpendicular to the axial direction of the plug.

The projection portion 41 is also in a pillar shape in which the cross section perpendicular to the axial direction of the plug meets the specific shape. The projection portion 41 is formed such that the height in the axial direction of the plug will be constant.

Figure 15:
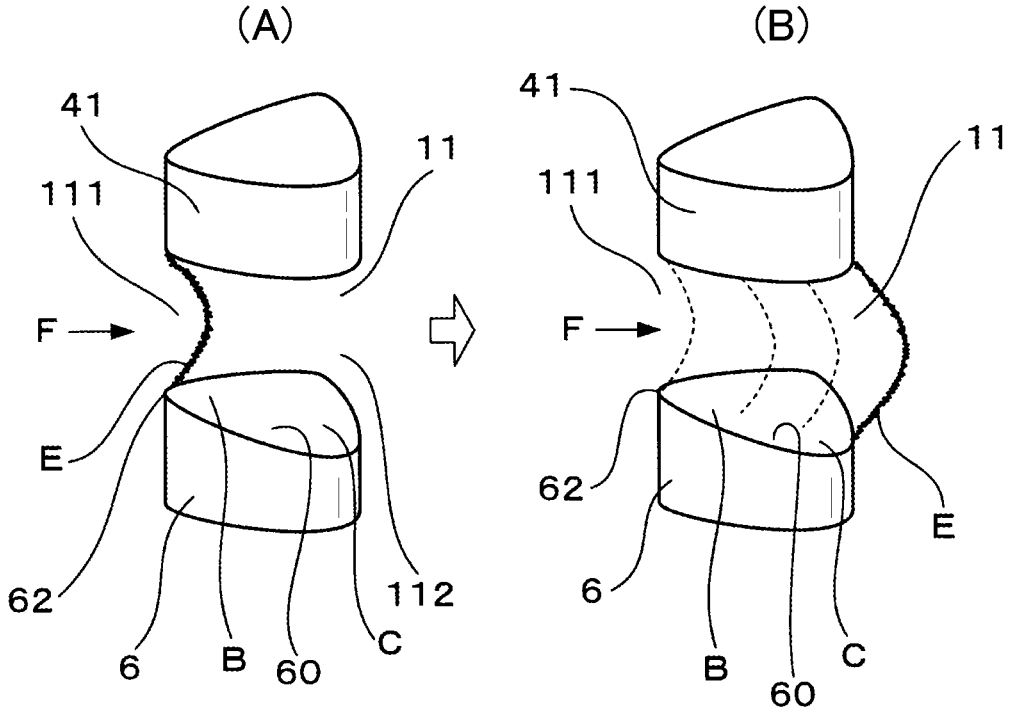
FIG. 15 is an explanatory view illustrating the projection portion according to the fifth embodiment, specifically showing by (A) a state of discharge and by (B) movement of a discharge spark.

Referring to FIG. 15, hereinafter is specifically described a relationship between movement of the discharge spark E in the projection portions when a discharge is caused, and wear of the projection portions, in the spark plug 1 of the present embodiment.

A predetermined voltage is applied across the center electrode 4 and the ground electrode 5 to cause a discharge in the spark discharge gap 11. In this case, as shown in FIG. 15 by (A), the discharge spark E is initially caused upstream in the projection portion 6. Specifically, the initial discharge spark E is caused in the minimum curvature radius portion 62 (see FIG. 12) where the field intensity is likely to be large.

Then, as shown in FIG. 15 by (B), the discharge spark E is drifted downstream by the flow F of the air-fuel mixture, while increasing the discharge length. At the edge 66 downstream in the projection portion 6, the discharge spark E is expanded. During this period, the air-fuel mixture is ignited by the discharge spark E. Although the discharge spark E is expanded and then extinguished at the edge portion 66 downstream in the projection portion 6, re-discharge is repeatedly caused at the same portion, i.e. at the edge portion 66 downstream in the projection portion 6.

The rest other than the above is similar to the first embodiment.

Figure 13:
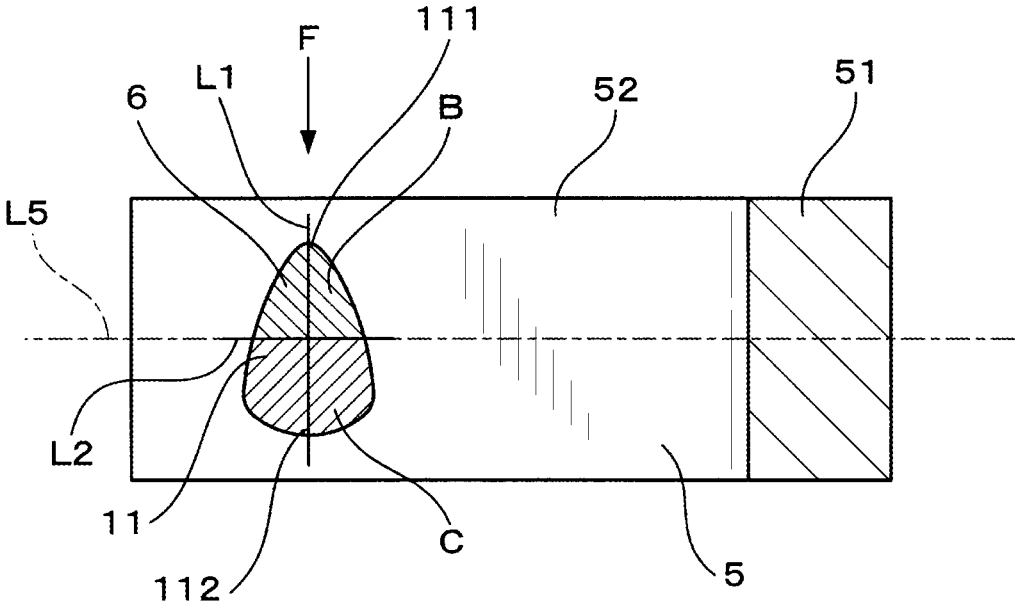
FIG. 13 is an explanatory view according to the fifth embodiment, the view corresponding to FIG. 8.

In the present embodiment, the projection section 6 is formed such that the cross section perpendicular to the axial direction of the plug will be in the specific shape. Specifically, as shown in FIG. 12, the area of the second region C in the cross section is ensured to be larger than the area of the first region B. As shown in FIG. 13, in mounting the spark plug 1 to the combustion chamber 70 of the internal combustion engine 7, the spark plug 1 is arranged such that the first region B (narrow gap 111 side) of the projection portion 6 is located upstream of the second region C (wide gap 112 side) with respect to the flow F of the air-fuel mixture in the combustion chamber 70. Thus, the life of the spark plug 1 is lengthened. Specifically, with the arrangement as described above, the second region C having a larger area can be arranged downstream in the flow F in the projection portion 6. Accordingly, when re-discharge is repeatedly caused, as mentioned above, in the edge portion 66 downstream in the projection portion 6, the larger area can minimize the expansion of the range of wear in the projection section 6 due to the re-discharges. Thus, disproportionate wear is minimized in the projection portion 6 and hence wear resistance is further enhanced. As a result, the life of the spark plug 1 is effectively enhanced.

Further, electric field can be most easily concentrated in the vicinity of the minimum curvature radius portion 62 and hence the minimum curvature radius portion 62 is likely to serve as a start point of discharge. Accordingly, the minimum curvature radius portion 62 is arranged upstream, so that, as shown in FIG. 15 by (A), the discharge spark E is initially obtained on an upstream side in the projection portion 6. This guarantees, as shown in FIG. 15 by (B), time before the discharge spark E is drifted downstream by the air-fuel mixture and blown off. Thus, an ignition opportunity for the flame is well ensured. As a result, ignitability of the spark plug 1 can be effectively enhanced.

The configuration described above is realized by permitting the projection portion 6 to have the cross section in the specific shape. Thus, quenching action can be suppressed without the necessity of particularly increasing the diameter of the projection portion 6. As a result, ignitability of the spark plug 1 is effectively prevented from being impaired.

As shown in FIG. 13, the projection portion 6 is arranged such that the first straight line L1 will be perpendicular to the extending direction of the opposing portion 52 of the ground electrode 5. Thus, the flow F directed to the discharge spark gap 11 is reliably prevented from being blocked by the ground electrode 5. At the same time, the second region C is ensured to be located downstream in the flow F and the first region B is ensured to be located upstream in the flow F. Accordingly, as described above, an opportunity for the ignition is well ensured, while wear resistance of the projection portion 6 is enhanced. As a result, ignitability is more effectively enhanced, while the life of the spark plug 1 is enhanced.

Other than the above, the advantageous effects similar to those of the first embodiment can be obtained.

Sixth Embodiment

Figure 16:
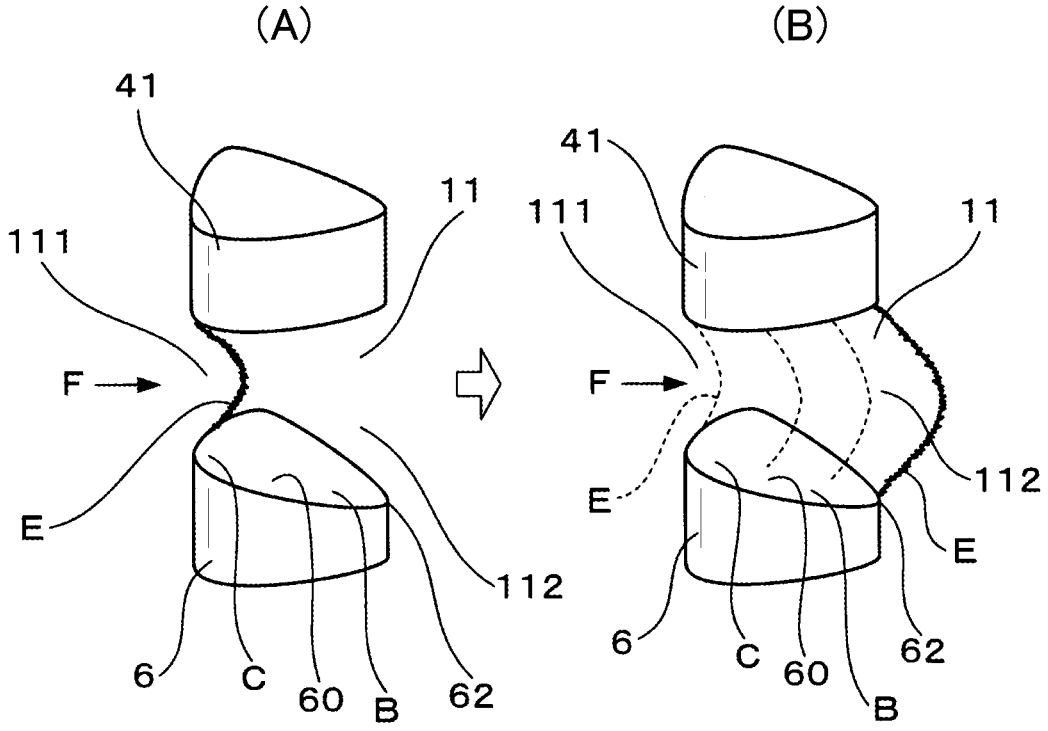
FIG. 16 is an explanatory view illustrating a projection portion according to a sixth embodiment, specifically showing by (A) a state of discharge and by (B) movement of a discharge spark.

As shown in FIG. 16, in the present embodiment, the ground electrode 5 of the spark plug 1 is provided with the projection portion 6 whose cross section perpendicular to the axial direction of the plug is in the specific shape shown in FIG. 12. In this case, the second region C of the projection portion 6 is ensured to be arranged upstream of the first region B with respect to the flow F of the air-fuel mixture in the combustion chamber 70.

In the present embodiment as well, the projection portion 6 has a cross section perpendicular to the axial direction of the plug. Specifically, the cross section includes the minimum curvature radius portion 62 having the smallest curvature radius in the contour 61 thereof and is in the specific shape that meets the requirement shown in the fifth embodiment (see FIG. 12).

In the present embodiment, as shown in FIG. 16, the wide gap 112 is formed in the minimum curvature radius portion 62 of the first region B, and the narrow gap 111 is formed in the second region C.

Particularly, in the present embodiment, in mounting the spark plug 1 to the combustion chamber 70 of the internal combustion engine 7, the projection portion 6 is arranged such that the second region C (narrow gap 111 side) is located upstream of the first region B (wide gap 112 side) with respect to the flow F of the air-fuel mixture in the combustion chamber 70.

The rest other than the above is similar to the fifth embodiment.

In the present embodiment, the projection portion 6 is formed so that its cross section perpendicular to the axial direction of the plug will be in the specific shape. Specifically, the projection portion 6 is formed such that the area of the second region C in the cross section is ensured to be larger than the area of the first region B (see FIG. 12). As shown in FIG. 16, in mounting the spark plug 1 to the combustion chamber 70 of the internal combustion engine 7, the projection portion 6 is arranged such that the second region C of the projection portion 6 is located upstream of the first region B with respect to the flow F of the air-fuel mixture in the combustion chamber 70. Thus, the life of the spark plug 1 can be lengthened. Specifically, with the arrangement described above, the second region C having a larger area is located upstream in the flow F in the projection portion 6 (narrow gap 111 side), where an initial discharge is caused. Therefore, as shown in FIG. 16 by (A), when initial discharge is repeatedly caused in the edge portion 66 on the upstream side in the projection portion 6, the larger area can minimize the expansion of the range of wear in the projection portion 6 due to the discharges. Thus, wear of the projection portion 6 is minimized and wear resistance is more enhanced. In other words, expansion of the narrow gap 111 is minimized and discharge voltage is minimized. As a result, the life of the spark plug 1 is effectively enhanced.

With the arrangement as described above, the minimum curvature radius portion 62 is located downstream in the first region B. Volume in the vicinity of the minimum curvature radius portion 62 is the smallest. Accordingly, quenching action can be more easily suppressed in the edge portion 66 on the downstream side in the projection portion 6, where the discharge spark E is blown and elongated. This guarantees, as shown in FIG. 16 by (B), time before the discharge spark E is drifted downstream by the air-fuel mixture and blown off. Thus, an opportunity for the flame is well ensured. As a result, ignitability of the spark plug 1 is more effectively enhanced.

Other than the above, the advantageous effects similar to those of the fifth embodiment are obtained.

Seventh Embodiment

Figure 17:
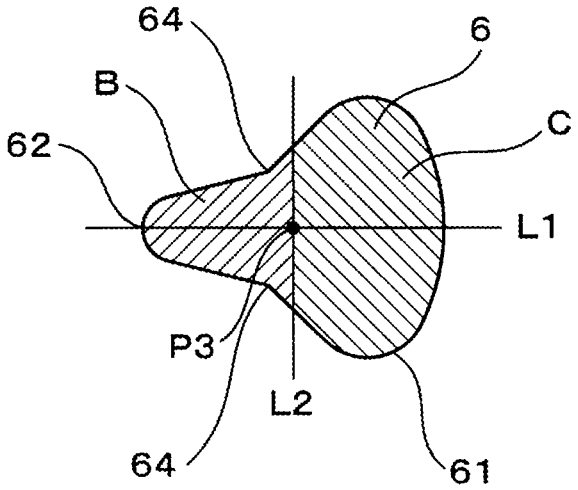
FIG. 17 is an explanatory view illustrating a projection portion according to a seventh embodiment, specifically showing by (A) a cross section corresponding to FIG. 12 and by (B) a perspective corresponding to FIG. 14.
Figure 17:
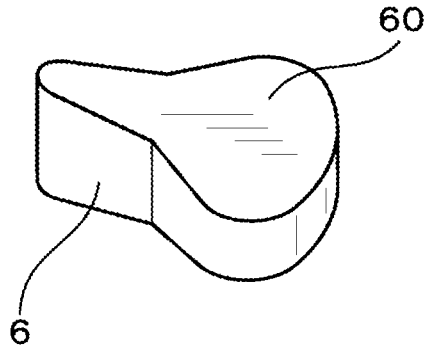

In the present embodiment, as shown in FIG. 17 by (A) and (B), the projection portion 6 in the specific shape is formed such that the difference in the area between the first region B and the second region C will be larger.

In the projection portion 6 of the present embodiment, the cross section perpendicular to the axial direction of the plug has the contour 61 in which recessed portions 64 are partially formed. Each recessed portion 64 is recessed toward a midpoint P3 of the first line segment M and extends from the minimum curvature radius portion 62 of the first region B to a part of the second region C in the cross section. Thus, as shown in FIG. 17 by (A), the projection portion 6 is formed such that, in the cross section perpendicular to the axial direction of the plug, the area of the first region B is ensured to be particularly smaller than the area of the second region C and that the difference in the area will be larger.

The projection portion 41 may also have a cross section similar to that of the projection portion 6 of the present embodiment.

The spark plug 1 of the present embodiment is configured such that the narrow gap 111 is formed in the minimum curvature radius portion 62 of the first region B and the wide gap 112 is formed in the second region C.

The rest other than the above is similar to the fifth embodiment.

In the present embodiment, in the projection portion 6, electric field is easily concentrated in the first region B that includes the minimum curvature radius portion 62 and thus the minimum curvature radius portion 62 is likely to be used as a start point of discharge. Therefore, an opportunity for the ignition is easily ensured. Further, wear resistance in the second region C is more easily enhanced. As a result, ignitability and life of the spark plug 1 is effectively enhanced.

Other than the above, the advantageous effects similar to those of the fifth embodiment can be obtained.

Eighth Embodiment

Figure 18:
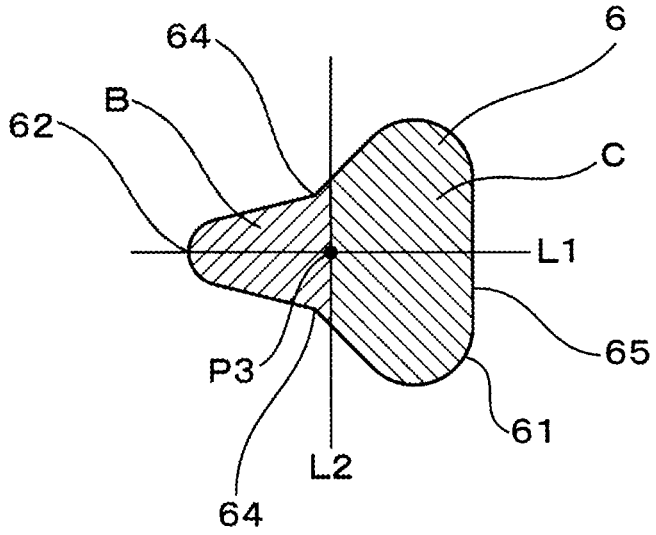
FIG. 18 is an explanatory view illustrating a projection portion according to an eighth embodiment, specifically showing by (A) a cross section corresponding to FIG. 12 and by (B) a perspective corresponding to FIG. 14.
Figure 18:
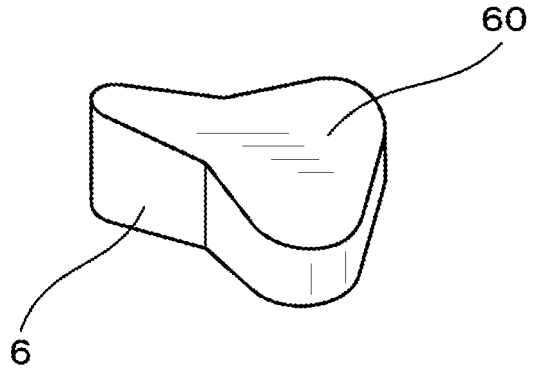

As shown in FIG. 18 by (A) and (B), in the present embodiment as well, the recessed portions 64 are provided in the contour 61 of the projection portion 6 that is in the specific shape to increase the difference in the area between the first region B and the second region C.

In the present embodiment, a straight portion 65, which is perpendicular to the first straight line L1, is formed in a part of the contour 61 of the second region C, in the specific shape of the projection section 6.

The rest other than the above is similar to the fifth embodiment.

The spark plug 1 of the present embodiment is configured such that the narrow gap 111 will be formed in the minimum curvature radius portion 62 of the first region B and the wide gap 112 will be formed in the second region C.

Other than the above, the advantageous effects similar to those of the fifth embodiment are obtained.

The seventh and eighth embodiments described above have a configuration in which the narrow gap 111 is formed in the minimum curvature radius portion 62 of the first region B and the wide gap 112 is formed in the second region C. However, alternative to this, the wide gap 112 may be formed in the minimum curvature radius portion 62 of the first region B and the narrow gap 111 may be formed in the second region C. In this case, the advantageous effects shown in the sixth embodiment are further exerted.

Comparative Example 1

Figure 19:
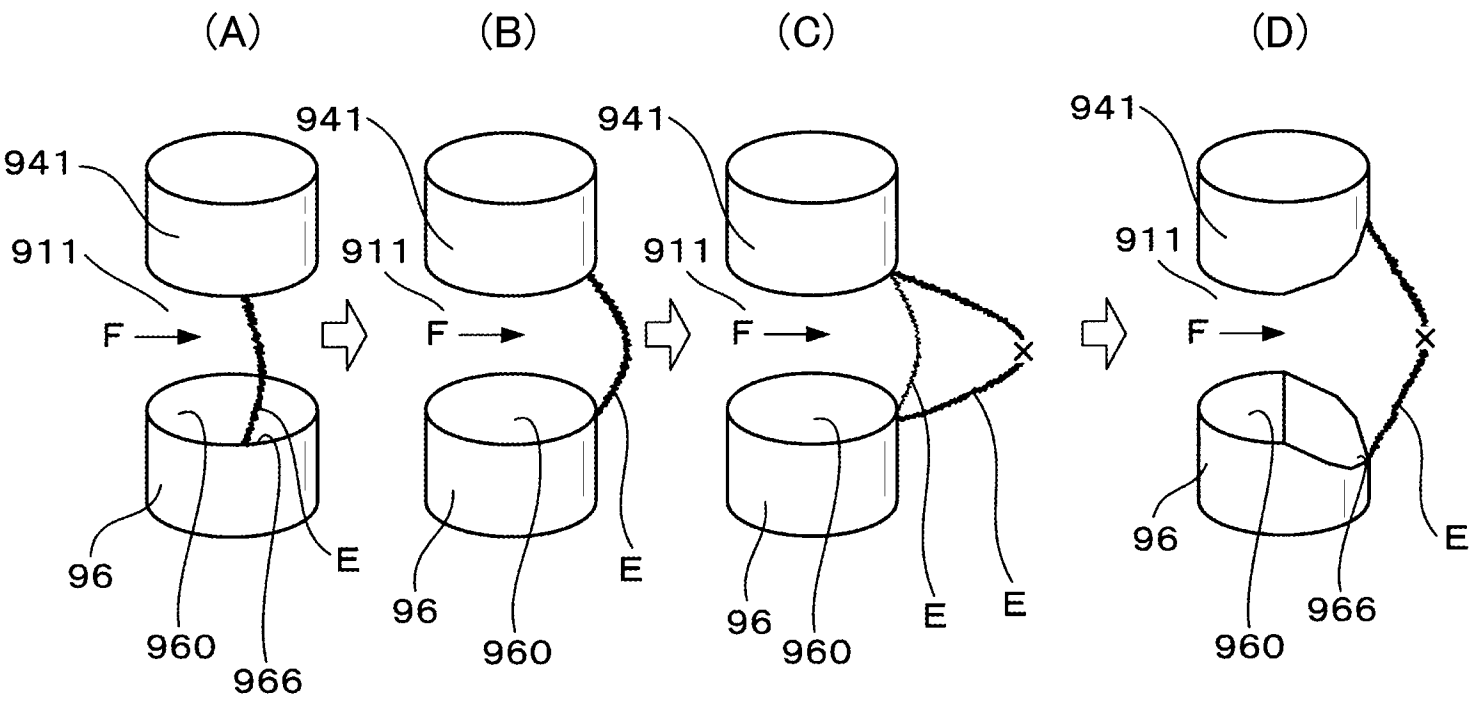
FIG. 19 is an explanatory view illustrating a projection portion in a spark plug according to Comparative Example 1, specifically showing by (A) a state of discharge, by (B) movement of a discharge spark, by (C) blow-off of the discharge spark and re-discharge, and by (D) a state of disproportionate wear.

As shown in FIG. 19, the present example shows a relationship between movement of the discharge spark E in the projection portion 96 when a discharge is caused, and wear of the projection portion 96 in the normal spark plug 9.

Figure 1:
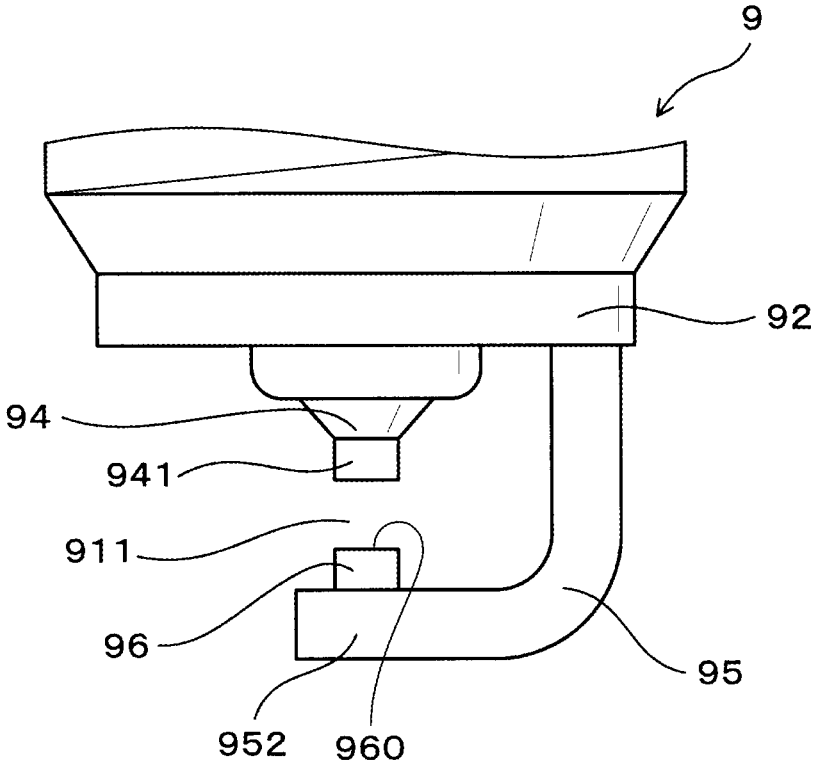
FIG.1 (RELATED ART)
FIG. 1 is an explanatory view illustrating a tip portion of a spark plug in a background art.
Figure 2:
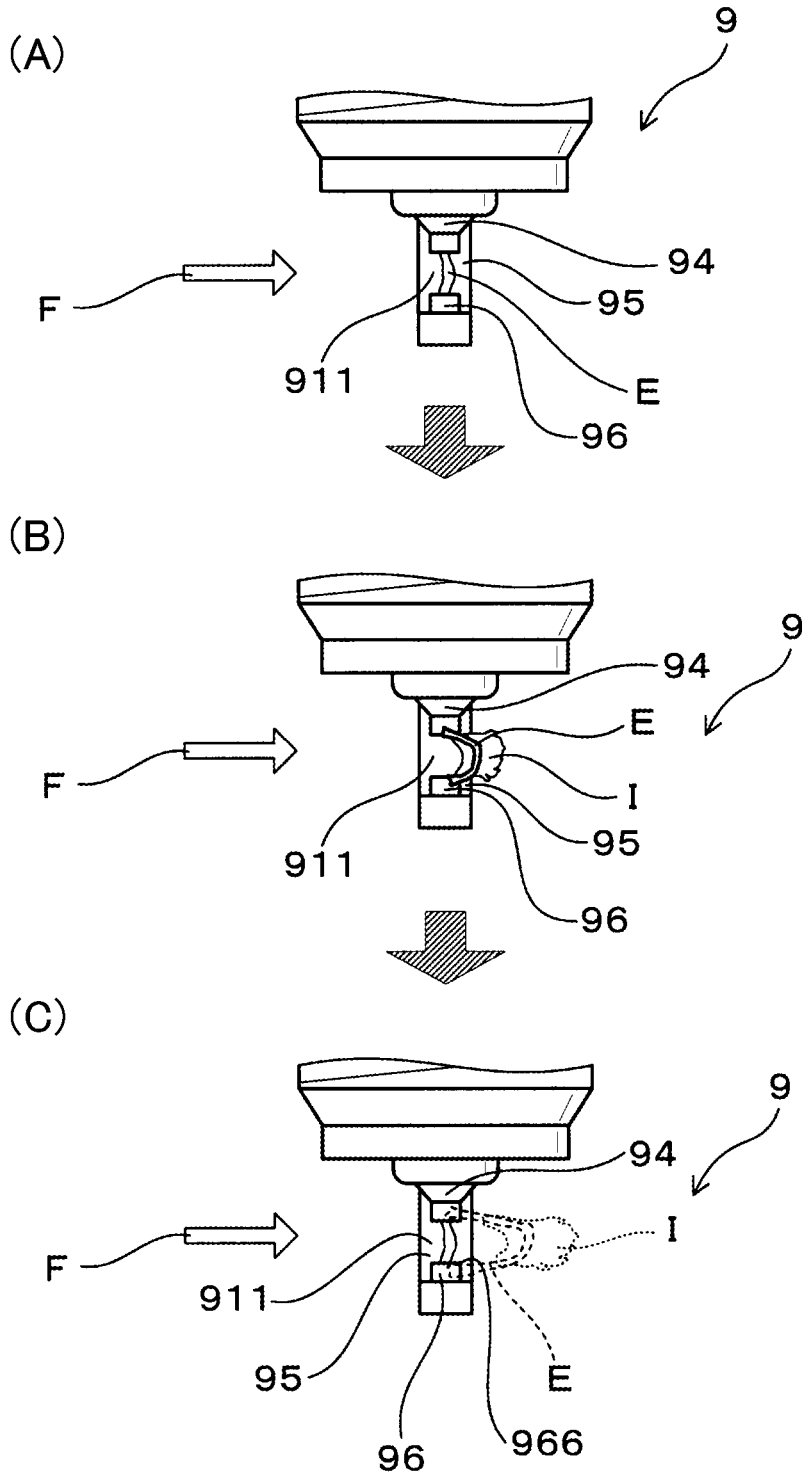
FIG.2 (RELATED ART)
FIG. 2 is an explanatory view illustrating the tip portion of the spark plug in the background art, specifically showing by (A) a state of discharge, by (B) a state where a discharge spark is blown and elongated by a gas flow, and by (C) a state where the discharge is cut.

The spark plug 9 of the present example has a configuration in which the tip portion of the center electrode 94 and the opposing portion 952 of the ground electrode 95 are both provided with projection portions 941 and 96, respectively. The projection portions 941 and 96 are projected toward the spark discharge gap 911 and are in substantially a pillar shape (see FIG. 1).

The rest other than the above is similar to the first embodiment.

When the spark plug 9 is used, being mounted on an internal combustion engine, i.e. when a discharge is caused, the discharge spark E is initially caused, as shown in FIG. 19 by (A), at some portion of the edge portion 966 of the projection portion 96. However, the position is not particularly specified, or the position is not necessarily upstream in the flowing direction of the flow F. Accordingly, depending on the position at which an initial discharge is caused, time is likely to be short before the discharge spark E drifts downstream by the air-fuel mixture and blown away, and thus opportunities for the ignition are reduced. Then, as shown in FIG. 19 by (B), the discharge spark E is drifted downstream in the projection portion 96 by the flow F. Then, as shown in FIG. 19 by (C), the discharge spark E is expanded and extinguished before the air-fuel mixture is heated by the discharge spark E in the spark discharge gap 911. Then, at the same position, i.e. at the edge portion 966 downstream in the projection portion 96, re-discharge is repeatedly caused. Therefore, as shown in FIG. 19 by (D), disproportionate wear occurs in the edge portion 966 downstream in the projection portion 96. As a result, the life of the spark plug 9 is shortened.

Experimental Example 1

Figure 20:
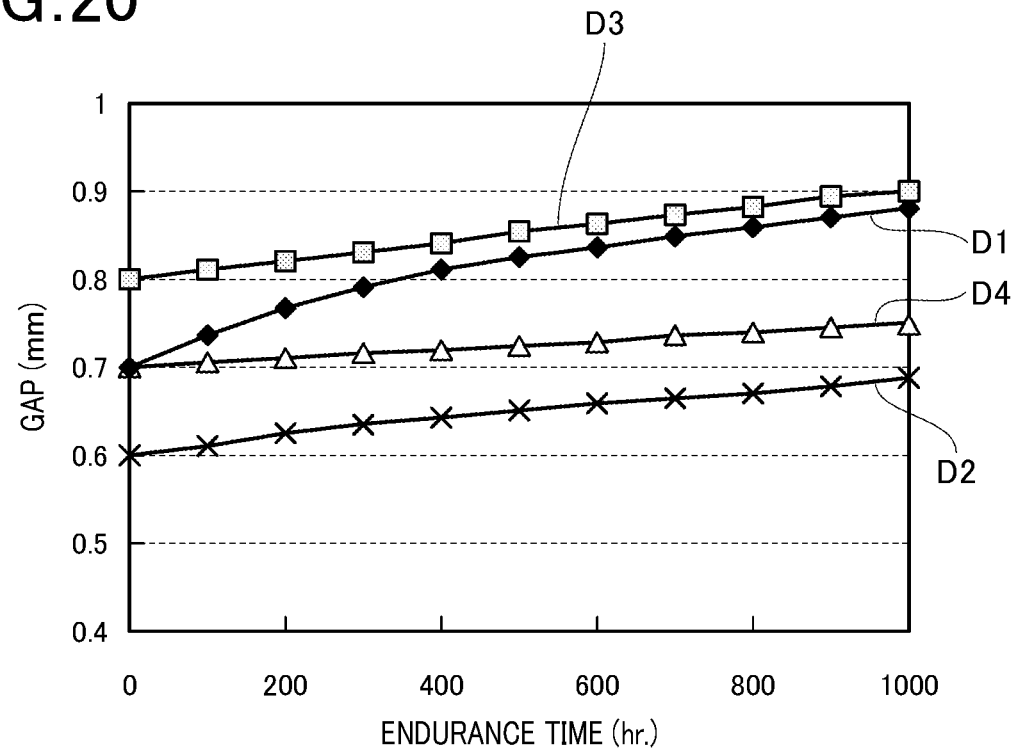
FIG. 20 is a diagram illustrating a relationship between endurance time and gap, according to Experimental Example 1.

As shown in FIG. 20, in the present example, wear resistance is researched for the projection portion of a spark plug, by measuring the amount of expansion of the spark discharge gap (hereinafter, this is adequately referred to as gap expansion amount).

As targets of evaluation, "Specimen 1" and "Specimen 2" of the spark plug 1 of the first embodiment were prepared, in which the opposing face 60 of the projection portion 6 provided at the ground electrode 5 is inclined with respect to a plane perpendicular to the axial direction of the plug. Further, "Specimen 3" and "Specimen 4" of the spark plug 9 shown in Comparative Example 1 were prepared, in which the opposing face 960 of the projection portion 96 provided at the ground electrode 95 is rendered to be perpendicular to the axial direction of the plug.

In the spark plugs of Specimens 1 to 4, the opposing face of the projection portion provided at the center electrode is perpendicular to the axial direction of the plug.

Further, in Specimen 1, the projection portion of the center electrode is in a pillar shape with a diameter of 0.7 mm and a height of 0.6 mm in the axial direction of the plug. The projection portion of the ground electrode has a diameter of 0.7 mm and a smallest height of 0.5 mm and a largest height of 0.7 mm in the axial direction of the plug. Regarding the dimension of the spark discharge gap, the narrow gap is 0.7 mm and the wide gap is 0.9 mm.

In Specimen 2, the projection portion of the center electrode and the projection portion of the ground electrode have a diameter of 1.0 mm. Regarding the dimension of the spark discharge gap, the narrow gap is 0.5 mm and the wide gap is 0.7 mm. The rest other than the above is similar to Specimen 1.

In Specimen 3, the projection portion of the center electrode and the projection portion of the ground electrode are in a pillar shape with a diameter of 0.7 mm and a height of 0.6 mm in the axial direction of the plug. The dimension of the spark discharge gap is 0.8 mm.

In Specimen 4, the projection portion of the center electrode and the projection portion of the ground electrode are in a pillar shape with a diameter of 1.0 mm and a height of 0.6 mm in the axial direction of the plug. The dimension of the spark discharge gap is 0.6 mm.

In Specimens 1 to 4, the projection portion of the center electrode is configured by a noble metal chip which is made of an iridium alloy, while the projection portion of the ground electrode is configured by a noble metal chip which is made of a platinum alloy. Between Specimens 1 and 3 and between Specimens 2 and 4, the volume of the projection portion is the same and the amount of material in use is the same. Specimens 3 and 4 are set such that the initially required voltage will be the same.

Three sample spark plugs were prepared for each of Specimens 1 to 4.

Using these specimens, the following endurance test was conducted.

In performing the endurance test, the specimen spark plugs were loaded on a testing device that resembles to a combustion chamber, creating a nitrogen atmosphere in the device at a pressure of 0.6 MPa.

Further, an air-fuel mixture was sent into the device so as to form a flow at a flow speed of 30 m/sec in the vicinity of the tip portion of each spark plug, and a voltage was applied to each spark plug at a discharge cycle of 30 Hz. Ignition energy in this instance was 70 mJ.

Each spark plug, when loaded on the device, was in a posture in which the vertical portion of the ground electrode (see reference 51 of FIG. 3) was located at a position that allows the vertical portion to be perpendicular to the direction of the gas flow.

FIG. 20 shows the results of the endurance test. In the figure, the line graph connecting rhombic plots assigned with a reference D1 shows measurement results of Specimen 1, while the line graph connecting x-mark plots assigned with a reference D2 shows measurement results of Specimen 2. Further, the line graph connecting rectangular plots assigned with a reference D3 shows measurement results of Specimen 3. The line graph connecting triangular plots assigned with a reference D4 shows measurement results of Specimen 4. Each measurement value reflects an average value of the actual measurement values of the three samples of each specimen.

The vertical axis of the graphs shown in the figure indicates gap (mm) in the spark discharge gap, and the horizontal axis indicates endurance time (hours).

As will be understood from FIG. 20, the gap is gradually expanded in all of the specimens with passage of the endurance time. In Specimen 1 (D1), the gap is hardly expanded comparing with Specimen 3 (D3). In other words, in Specimen 1, the expansion speed of the narrow gap is high in the initial stage of the duration test and thus the expansion speed of the spark discharge gap is high, but the expansion of the gap thereafter is suppressed. The size of the spark discharge gap of Specimen 1 is smaller than the size of the spark discharge gap of Specimen 3 and the gap expands at an even and moderate expansion speed. Thus, finally, the expansion of the spark discharge gap is suppressed in Specimen 1, compared to Specimen 3 that has the same volume and uses the same amount of material as those of Specimen 1.

Similarly, in Specimen 2 (D2) as well, the spark discharge gap is hardly expanded, compared to Specimen 4 (D4) that has the same volume and uses the same amount of material as those of Specimen 2.

As described above, it will be understood from the present example that the expansion of the spark discharge gap is more suppressed in the spark plug of the first embodiment than in the spark plug of Comparative Example 1.

Experimental Example 2

Figure 21:
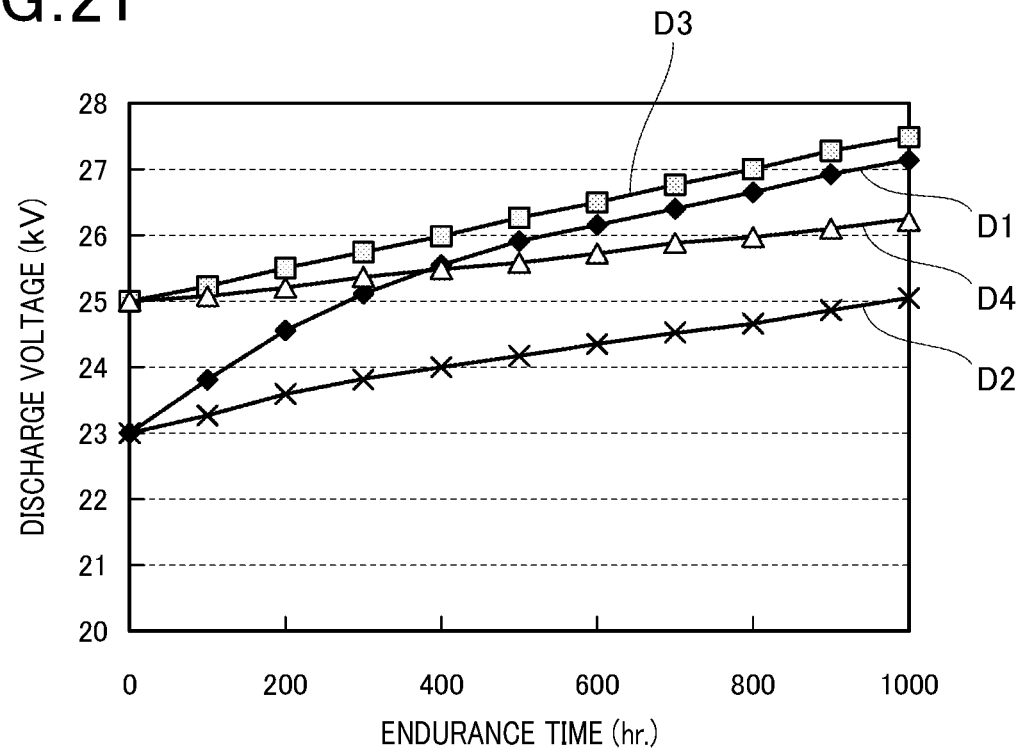
FIG. 21 is a diagram illustrating a relationship between endurance time and discharge voltage, according to Experimental Example 2.

As shown in FIG. 21, in the present example, wear resistance is researched for the projection portion of a spark plug, by measuring the discharge voltage.

In general, discharge voltage increases with the expansion of the spark discharge gap. In this regard, in the endurance test of the present example, the voltage of each spark discharge was measured to confirm whether the discharge voltage of the spark plug according to the first embodiment was suppressed compared to that of Comparative Example 1.

In the present example, the method of endurance test and conditions of the targets of evaluation (Specimens 1 to 4) are the same as those of Experimental Example 1. For each specimen, discharge voltage of each of 1000 spark discharges was measured for every lapse of 100 hours of endurance time. In the measurements, the maximum values of the discharge voltages were measured for the three samples of each specimen and the three maximum values were averaged as shown in the plots of FIG. 21.

FIG. 21 shows the results of the measurements. In the figure, the line graph connecting rhombic plots assigned with a reference D1 shows measurement results of Specimen 1, while the line graph connecting x-mark plots assigned with a reference D2 shows measurement results of Specimen 2. Further, the line graph connecting rectangular plots assigned with a reference D3 shows measurement results of Specimen 3. The line graph connecting triangular plots assigned with a reference D4 shows measurement results of Specimen 4. Each measurement value reflects an average value of the actual measurement values of the three samples of each specimen.

The vertical axis of the graphs shown in the figure indicates discharge voltage (kV), and the horizontal axis indicates endurance time (hours).

As will be understood from FIG. 21, the discharge voltage gradually increases in all of the specimens with passage of the endurance time. In Specimen 1 (D1), the discharge voltage hardly increases compared to Specimen 3 (D3). In other words, in Specimen 1, the discharge voltage comparatively rapidly increases at the initial stage of the endurance test with the expansion of the narrow gap, but the increase of discharge voltage thereafter is suppressed. The discharge voltage in the spark discharge gap of Specimen 1 is smaller in the value than the discharge voltage of the spark discharge gap of Specimen 3 and increases at an even and moderate climbing speed. Thus, finally, the increase of the discharge voltage is suppressed in Specimen 1, compared to Specimen 3 that has the same volume and uses the same amount of material as those of Specimen 1.

Similarly, in Specimen 2 (D2) as well, the discharge voltage hardly increases, compared to Specimen 4 (D4) that has the same volume and uses the same amount of material as those of Specimen 2.

As described above, it will be understood from the present example that the increase of discharge voltage is more suppressed in the spark plug according to the first embodiment than in the spark plug of Comparative Example 1.

Experimental Example 3

Figure 22:
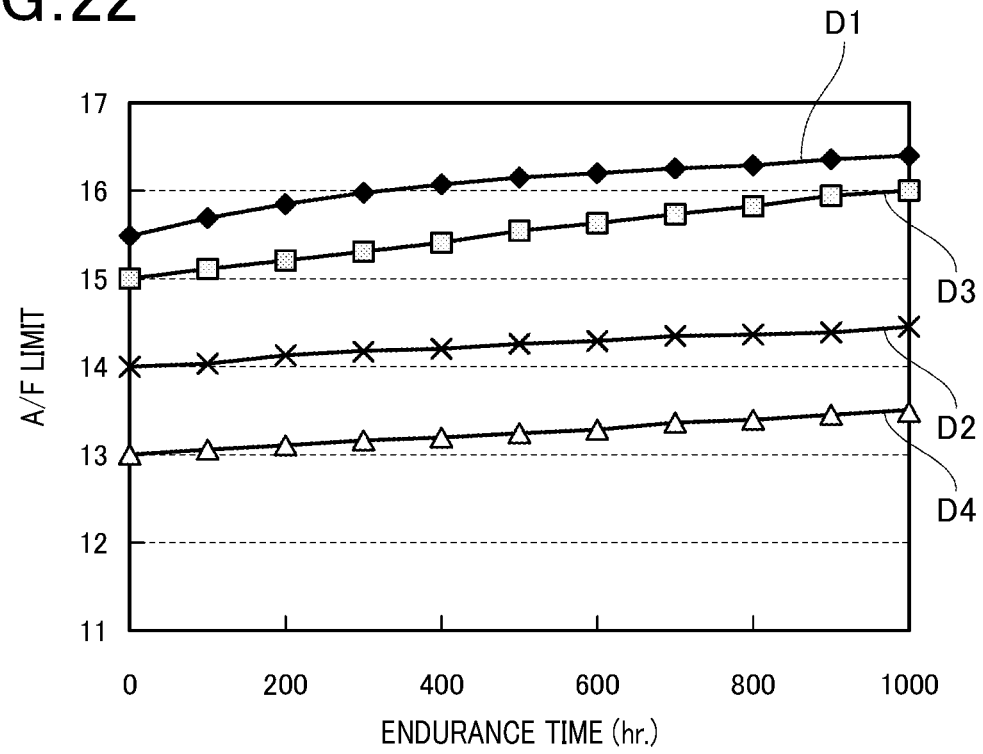
FIG. 22 is a diagram illustrating a relationship between endurance time and A/F limit, according to Experimental Example 3.

As shown in FIG. 22, in the present example, ignitability of a spark plug is researched, by measuring an A/F (Air-Fuel ratio) limit.

In the present example, each A/F limit value was measured to confirm whether the ignitability of the spark plug according to the first embodiment is enhanced compared to that of Comparative Example.

In the present example, the method of endurance test and conditions of the targets of evaluation (Specimens 1 to 4) are the same as those of Experimental Example 1. For each specimen, the value of the A/F limit was measured for every lapse of 100 hours of endurance time. The value of the A/F limit was measured using an in-line four-cylinder engine. In the measurements, the values of the A/F limit were measured for the three samples of each specimen and the three actual measurement values were averaged as shown in the plots of FIG. 22.

FIG. 22 shows the results of the measurements. In the figure, the line graph connecting rhombic plots assigned with a reference D1 shows measurement results of Specimen 1, while the line graph connecting x-mark plots assigned with a reference D2 shows measurement results of Specimen 2. Further, the line graph connecting rectangular plots assigned with a reference D3 shows measurement results of Specimen 3. The line graph connecting triangular plots assigned with a reference D4 shows measurement results of Specimen 4.

The vertical axis of the graphs shown in the figure indicates values of the A/F limit and the horizontal axis indicates endurance time (hours).

As will be understood from FIG. 22, the A/F limit gradually increases in all of the specimens with passage of the endurance time. In Specimen 1 (D1), the A/F limit is higher than in Specimen 3 (D3). In other words, Specimen 1 has ignitability which is superior to that of Specimen 3 that has the same volume and using the same amount of material as those of Specimen 1.

Similarly, in Specimen 2 (D2) as well, the A/F limit is higher than in Specimen 4 (D4) that has the same volume and uses the same amount of material as those of Specimen 2, and thus Specimen 2 has better ignitability than Specimen 4 that has the same volume and uses the same amount of material as those of Specimen 2.

As described above, as will be understood from the present example, the spark plug according to the first embodiment has ignitability superior to the spark plug of Comparative Example 1.

In the foregoing embodiments, the opposing face that confronts the spark discharge gap is configured to be inclined with respect to the plane perpendicular to the axial direction of the plug. This configuration may be applied to the projection portion of either of the center electrode and the ground electrode, or may be applied to the projection portion of both of the center electrode and the ground electrode.

DESCRIPTION OF SYMBOLS

1 Spark plug
2 Housing
3 Insulation porcelain
4 Center electrode
41 Projection portion
410 Opposing face
5 Ground electrode
52 Opposing face
6 Projection portion
60 Opposing face
11 Spark discharge gap
111 Narrow gap
112 Wide gap

The invention claimed is:

1. A spark plug for an internal combustion engine, comprising a cylindrical housing, a cylindrical insulation porcelain held inside the housing, a center electrode held inside the insulation porcelain, with a tip portion thereof being projected, and a ground electrode connected to the housing and having an opposing portion opposed to the center electrode in an axial direction of the plug to form a spark discharge gap between the center electrode and the ground electrode, wherein both of the tip portion of the center electrode and the opposing portion of the ground electrode have respective projection portions projected toward the spark discharge gap;

at least one of the projection portions has an opposing face confronting the spark discharge gap and inclined with respect to a plane perpendicular to the axial direction of the plug;

the spark discharge gap is configured to be gradually enlarged, in one direction perpendicular to the axial direction of the spark plug, from a narrow gap on one end side in the direction, the narrow gap having a gap length smaller than on the other end side, toward a wide gap on the other end side, the wide gap having a gap length larger than on the one end side;

at least one of the projection portions:

i) has a cross section perpendicular to the axial direction of the plug, the cross section including a minimum curvature radius portion having a smallest curvature radius in a contour of the cross section; and ii) is in a specific shape that meets a requirement, the requirement being that, when a first straight line is supposed to connect between the minimum curvature radius portion and a geometric centroid in the cross section, a first line segment is supposed to connect between two intersections at which the first straight line intersects the contour of the cross section, and a second straight line is supposed to be perpendicular to the first line segment at a midpoint in the first line segment, and when the cross section is divided by the second straight line into a first region that includes the minimum curvature radius portion and a second region that does not include the minimum curvature radius portion, the second region has an area larger than an area of the first region; and the wide gap is formed in the second region and the narrow gap is formed in the minimum curvature radius portion of the first region.

2. The spark plug for an internal combustion engine according to claim 1, wherein the opposing faces of the projection portions of both of the center electrode and the ground electrode are inclined in the same direction with respect to a plane perpendicular to the axial direction of the plug so as to be directed to a tip side of the spark plug as the opposing faces extend from the small gap side to the wide gap side.

3. The spark plug for an internal combustion engine according to claim 2, wherein the spark discharge gap is configured to be gradually enlarged along a direction that intersects an extending direction of the opposing portion of the ground electrode.

4. The spark plug for an internal combustion engine according to claim 3, characterized in that the spark discharge gap is configured to be gradually enlarged along a direction perpendicular to an extending direction of the opposing portion of the ground electrode.

5. The spark plug for an internal combustion engine according to claim 2, characterized in that the spark discharge gap is configured to be gradually enlarged along a direction perpendicular to an extending direction of the opposing portion of the ground electrode.

6. The spark plug for an internal combustion engine according to claim 1, wherein the cross sections of the projection portions of both of the center electrode and the ground electrode are each in the specific shape.

7. The spark plug for an internal combustion engine according to claim 6, wherein at least one of the projection portions is configured by a noble metal chip.

8. The spark plug for an internal combustion engine according to claim 1, wherein the spark discharge gap is configured to be gradually enlarged along a direction that intersects an extending direction of the opposing portion of the ground electrode.

9. The spark plug for an internal combustion engine according to claim 8, characterized in that the spark discharge gap is configured to be gradually enlarged along a direction perpendicular to an extending direction of the opposing portion of the ground electrode.

10. The spark plug for an internal combustion engine according to claim 1, characterized in that the spark discharge gap is configured to be gradually enlarged along a direction perpendicular to an extending direction of the opposing portion of the ground electrode.

11. The spark plug for an internal combustion engine according to claim 1, wherein at least one of the projection portions is configured by a noble metal chip.

12. A spark plug for an internal combustion engine, comprising a cylindrical housing, a cylindrical insulation porcelain held inside the housing, a center electrode held inside the insulation porcelain, with a tip portion thereof being projected, and a ground electrode connected to the housing and having an opposing portion opposed to the center electrode in an axial direction of the plug to form a spark discharge gap between the center electrode and the ground electrode, wherein both of the tip portion of the center electrode and the opposing portion of the ground electrode have respective projection portions projected toward the spark discharge gap;

at least one of the projection portions has an opposing face confronting the spark discharge gap and inclined with respect to a plane perpendicular to the axial direction of the plug;

the spark discharge gap is configured to be gradually enlarged, in one direction perpendicular to the axial direction of the spark plug, from a narrow gap on one end side in the direction, the narrow gap having a gap length smaller than on the other end side, toward a wide gap on the other end side, the wide gap having a gap length larger than on the one end side;

at least one of the projection portions:

i) has a cross section perpendicular to the axial direction of the plug, the cross section including a minimum curvature radius portion having a smallest curvature radius in a contour of the cross section; and ii) is in a specific shape that meets a requirement, the requirement being that, when a first straight line is supposed to connect between the minimum curvature radius portion and a geometric centroid in the cross section, a first line segment is supposed to connect between two intersections at which the first straight line intersects the contour of the cross section, and a second straight line is supposed to be perpendicular to the first line segment at a midpoint in the first line segment, and when the cross section is divided by the second straight line into a first region that includes the minimum curvature radius portion and a second region that does not include the minimum curvature radius portion, the second region has an area larger than an area of the first region; and the wide gap is formed in the minimum curvature radius portion of the first region and the narrow gap is formed in the second region.

13. The spark plug for an internal combustion engine according to claim 12, wherein the opposing faces of the projection portions of both of the center electrode and the ground electrode are inclined in the same direction with respect to a plane perpendicular to the axial direction of the plug so as to be directed to a tip side of the spark plug as the opposing faces extend from the small gap side to the wide gap side.

14. The spark plug for an internal combustion engine according to claim 13, wherein the spark discharge gap is configured to be gradually enlarged along a direction that intersects an extending direction of the opposing portion of the ground electrode.

15. The spark plug for an internal combustion engine according to claim 14, characterized in that the spark discharge gap is configured to be gradually enlarged along a direction perpendicular to an extending direction of the opposing portion of the ground electrode.

16. The spark plug for an internal combustion engine according to claim 12, wherein the cross sections of the projection portions of both of the center electrode and the ground electrode are each in the specific shape.

17. The spark plug for an internal combustion engine according to claim 12, wherein at least one of the projection portions is configured by a noble metal chip.

* * * * *